US009201361B2

(12) United States Patent
Fujimori

(10) Patent No.: US 9,201,361 B2
(45) Date of Patent: Dec. 1, 2015

(54) IMAGE FORMING APPARATUS

(71) Applicant: KONICA MINOLTA, INC., Chiyoda-ku, Tokyo (JP)

(72) Inventor: Harumitsu Fujimori, Machida (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/490,502

(22) Filed: Sep. 18, 2014

(65) Prior Publication Data

US 2015/0086230 A1 Mar. 26, 2015

(30) Foreign Application Priority Data

Sep. 20, 2013 (JP) ..... 2013-195287

(51) Int. Cl.
*G03G 15/20* (2006.01)

(52) U.S. Cl.
CPC ..... *G03G 15/2039* (2013.01)

(58) Field of Classification Search
CPC ..... G03G 2215/209; G03G 15/2039
See application file for complete search history.

(56) References Cited

U.S. PATENT DOCUMENTS

| | | | | |
|---|---|---|---|---|
| 2008/0181645 | A1* | 7/2008 | Nakamura | 399/70 |
| 2010/0123940 | A1* | 5/2010 | Kamisuwa | 358/452 |
| 2012/0213540 | A1* | 8/2012 | Igarashi | 399/69 |
| 2013/0273464 | A1* | 10/2013 | Kashiwagi | 430/30 |

FOREIGN PATENT DOCUMENTS

| | | | |
|---|---|---|---|
| JP | 10288911 | A | 10/1998 |
| JP | 2008046176 | A | 2/2008 |
| JP | 2008268784 | A | 11/2008 |

* cited by examiner

*Primary Examiner* — Gregory H Curran
(74) *Attorney, Agent, or Firm* — Holtz, Holtz, Goodman & Chick PC

(57) ABSTRACT

Provided is an image forming apparatus including: a heater heating a fixing member; an acquisition unit acquiring, when an image for one page includes a coded identifier image, information on a range of formation of the coded identifier image on a recording sheet in a sheet-passing direction; a target temperature switching unit switching a target temperature at which temperature of the fixing member is to be maintained at least between a first fixing temperature and a second fixing temperature higher than the first fixing temperature; a controller controlling the heater so that the temperature of the fixing member is maintained at the target temperature, wherein the target temperature switching unit switches the target temperature at a timing such that the temperature of the fixing member is equal to the second fixing temperature while a toner image in the range of formation of the coded identifier image is being fixed.

16 Claims, 29 Drawing Sheets

Original image

Fixing temperature change

FIG. 8
| | | | | | | | |
|---|---|---|---|---|---|---|---|
| T1→T2 | ts1 | | ts2 | | ts3 | ··· | |
| T2→T1 | | te1 | | te2 | | ··· | |
FIG. 9A
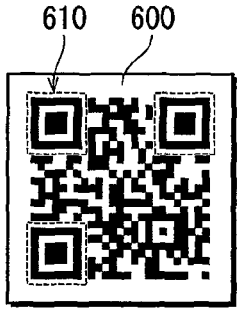
FIG. 9B
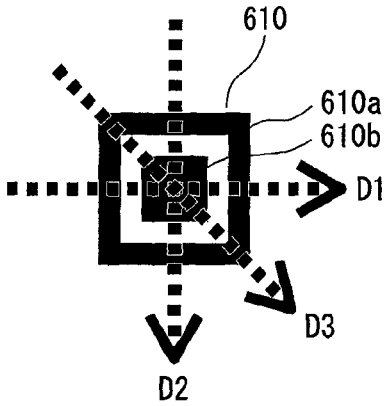
1:1:3:1:1

FIG. 11A

AAAAAAAAAAAAAAAAAAAA.
BBBBBBBBBBBBBBBBBBBB.
CCCCCCCCCCCCCCCCCCCC.
DDDDDDDDDDDDDDDDDDDD.
EEEEEEEEEEEEEEEEEEEE.
FFFFFFFFFFFFFFFFFFFF.

Original data

FIG. 11B

AAAAAAAAAAAAAAAAAAAA.
BBBBBBBBBBBBBBBBBBBB.
CCCCCCCCCCCCCCCCCCCC.
DDDDDDDDDDDDDDDDDDDD.
EEEEEEEEEEEEEEEEEEEE.
FFFFFFFFFFFFFFFFFFFF.

Copying machine adds identifier image

FIG. 11C

Second fixing temperature a0

AAAAAAAAAAAAAAAAAAAA.
BBBBBBBBBBBBBBBBBBBB.
CCCCCCCCCCCCCCCCCCCC.
DDDDDDDDDDDDDDDDDDDD.
EEEEEEEEEEEEEEEEEEEE.
FFFFFFFFFFFFFFFFFFFF.

Fixing temperature change

| | 1 | 2 | 3 |
|---|---|---|---|
| A | A1 | A2 | A3 |
| B | B1 | B2 | B3 |
| C | C1 | C2 | C3 |
| D | D1 | D2 | D3 |

| | 1 | 2 | 3 |
|---|---|---|---|
| A | A1 | A2 | A3 |
| B | B1 | B2 | B3 |
| C | C1 | C2 | C3 |
| D | D1 | D2 | D3 |

| | 1 | 2 | 3 |
|---|---|---|---|
| A | A1 | A2 | A3 |
| B | B1 | B2 | B3 |
| C | C1 | C2 | C3 |
| D | D1 | D2 | D3 |

IMAGE FORMING APPARATUS

This application is based on application No. 2013-195287 filed in Japan, the content of which is hereby incorporated by reference.

BACKGROUND OF THE INVENTION (1) Field of the Invention

The present invention relates to an image forming apparatus that can switch the temperature of a fixing member during fixing to a different value.

(2) Description of Related Art

In recent years, there has been increasing demand for power-saving electrophotographic image forming apparatuses. To meet the demand, technology for reducing power consumption of a fixing device included in an image forming apparatus by switching a fixing temperature according to the amount of toner to be fixed has been proposed.

For example, Japanese Patent Application Publication No. 10-288911 (hereinafter, referred to as "Patent Literature 1") discloses technology of counting the number of black dots in a predetermined number of lines in image data targeted for printing, and, when the counted number is smaller than a predetermined value, setting the temperature of a heating roller of the fixing device to a temperature lower than a normal temperature to save power.

This is because the amount of toner per unit area of an image having few black dots, which is typically a text image, is small, and fixing can be performed at a temperature reduced within a predetermined range. Furthermore, small deterioration of an image quality, if any, is hardly noticeable in the text image.

In recent years, there has been an increase in the number of cases where an image targeted for printing includes an image of given coded identification information (hereinafter, referred to as an "identifier image"), such as a QR code (a registered trademark of Denso Wave Incorporated, hereinafter the same applies) and a bar code. In such cases, switching of the fixing temperature using the technology disclosed in Patent Literature 1 described above might cause any inconvenience.

That is, since an identifier image is typically placed at a position in a margin at an end of a recording sheet in terms of layout, adoption of a "control method using the number of dots as a criterion of judgment" as disclosed in Patent Literature 1 described above is likely to cause the number of black dots to be judged to be smaller than a predetermined value. As a result, the fixing temperature is set to a low temperature, and the image quality is likely to be deteriorated due to poor fixing performed at the low temperature.

Users can recognize and understand text images and photo images included in printed materials even when an image quality thereof is deteriorated to some extent. Identifier images, however, cannot be recognized by users as they stand, and are required to be read by a code reader and the like, and decoded. When an image quality of an identifier image is deteriorated, it becomes difficult to accurately read and decode the identifier image and to acquire needed information. This makes the identifier image meaningless.

The present invention aims to provide an image forming apparatus that can form images without causing deterioration of the image quality of identifier images, while saving power by appropriately switching the fixing temperature.

SUMMARY OF THE INVENTION

The above-mentioned aim is achieved by an image forming apparatus that forms an image by causing a recording sheet on which an unfixed toner image is formed to pass through a fixing nip, and thermally fixing the toner image onto the recording sheet, the fixing nip being formed by pressing a pressing member against a fixing member that is heated, the image forming apparatus including: a heater heating the fixing member; an acquisition unit acquiring, when an image for one page includes a coded identifier image in which coded information is embedded, information on a range of formation of the coded identifier image on the recording sheet, the range being defined in terms of a sheet-passing direction; a target temperature switching unit switching a target temperature, the target temperature being a temperature at which temperature of the fixing member is to be maintained, and being switched at least between a first fixing temperature and a second fixing temperature that is higher than the first fixing temperature; a controller controlling the heater so that the temperature of the fixing member is maintained at the target temperature to which the target temperature switching unit has switched, wherein the target temperature switching unit switches the target temperature at a timing such that the temperature of the fixing member is equal to the second fixing temperature while a toner image in the range of formation of the coded identifier image is being fixed.

Coding herein means converting data in a certain form into data in another form according to a predetermined rule, and the coded identifier herein conceptually includes a two-dimensional code such as a QR code and a one-dimensional code such as a bar code.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings:

FIG. 8 shows an example of a target fixing temperature switching timing table created by the above-mentioned target fixing temperature switching timing determination processing;

FIG. 9A shows an example of a QR code, and FIG. 9B is an enlarged view of a pattern for detecting a position of the QR code;

FIGS. 11A, 11B, and 11C are diagrams for explaining addition of an identifier image to an original image, and an overview of the target fixing temperature switching processing in Embodiment 2;

DESCRIPTION OF PREFERRED EMBODIMENTS

The following describes an image forming apparatus in embodiments of the present invention as applied to a copying machine that can form color images.

Embodiment 1

Figure 1:
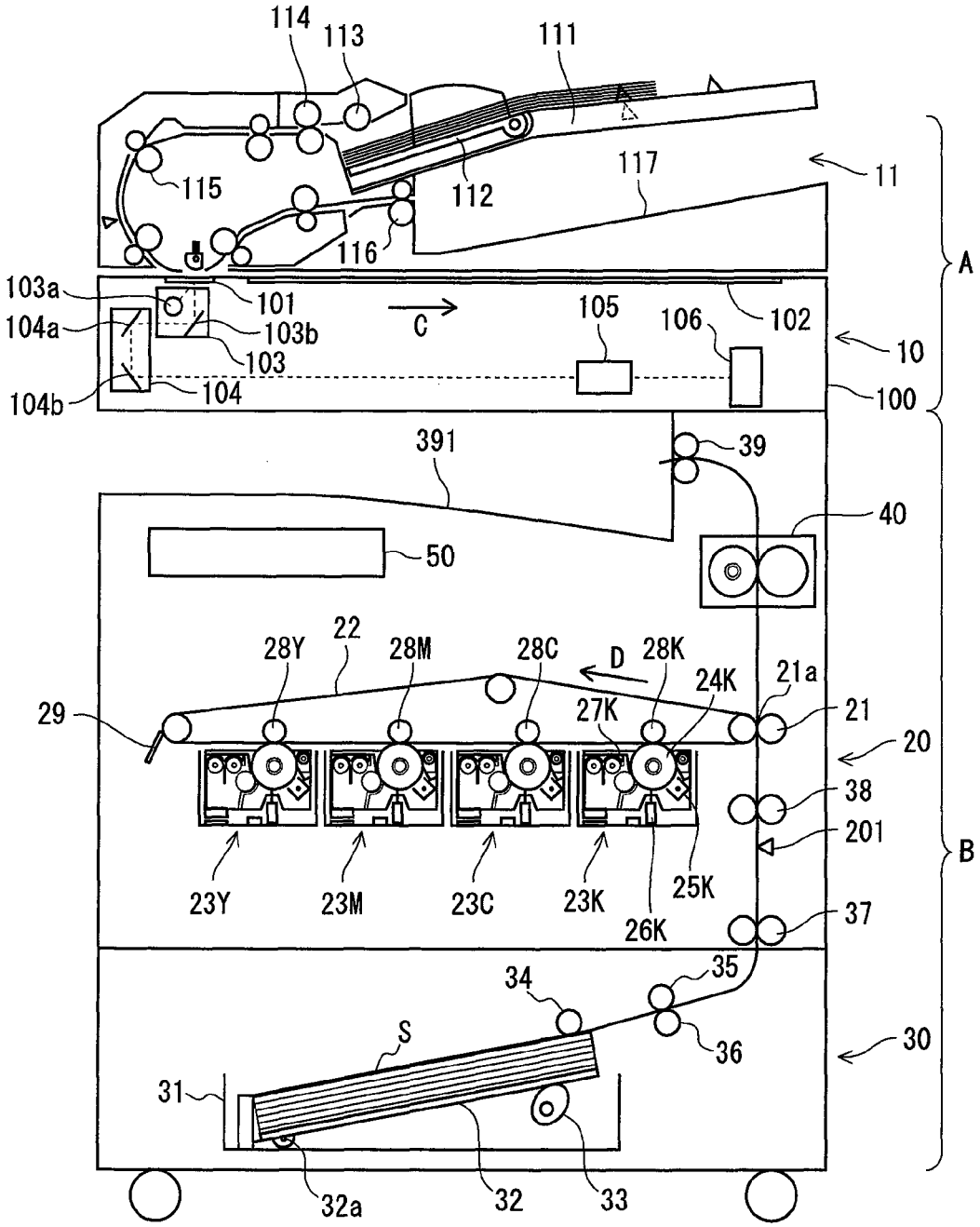
FIG. 1 shows the structure of a copying machine in Embodiment 1 of the present invention.

FIG. 1 is a schematic diagram for explaining the structure of a copying machine 1 in the present embodiment.

As shown in FIG. 1, the copying machine 1 mainly includes an image reading unit (a document scanning apparatus) A and a printing unit (an image forming apparatus) B.

The image reading unit A includes a scanning unit 10 and a document conveying unit (ADF unit) 11. The scanning unit 10 optically scans original images. The document conveying unit 11 is located above the scanning unit 10. The image reading unit A is configured to selectively perform scanning of original images by using a sheet-through method or a mirror scanning method.

The printing unit B forms, by using an electrophotographic method, color images on recording sheets based on original images scanned by the aforementioned image reading unit A or image data received from another terminal via a network.

The following describes the structure of each of the units.

(1) Image Reading Unit (1-1) Document Conveying Unit

The document conveying unit 11 picks up, by using a pick-up roller 113, document sheets from a stack of document sheets set on a document feeding tray 111 in the case of scanning by using the sheet-through method. The document conveying unit 11 separates the document sheets by using a separation roller unit 114, performs skew correction on each of the separated document sheets by using a registration roller pair 115, and feeds the document sheet to a scanning position on a first scanning glass 101 at an appropriate timing. After an original image is scanned at the scanning position, the document sheet is ejected onto a document ejection tray 117 via an ejection roller pair 116.

A lift plate 112 provided to the document feeding tray 111 is moved up by a cam mechanism (not illustrated) when the pick-up roller 113 picks up the document sheets so as to bring an upper surface of a document sheet at the top of the stack of document sheets into contact with the pick-up roller 113.

(1-2) Scanning Unit

At an upper surface of a housing 100 of the scanning unit 10, the first scanning glass 101 having a band plate-like shape, and a second scanning glass 102 having a flat plate-like shape are provided.

Inside the housing 100, a first slider 103, a second slider 104, a collective lens 105, a line sensor 106, and the like are provided.

The line sensor 106 is composed of a plurality of charge coupled devices (CCDs) arranged in a line in a direction parallel to a main scanning direction.

The first slider 103 is equipped with a linear light source 103*a* including an LED array and the like, and a first mirror 103*b*, and is slid by a drive motor (not illustrated) in a direction of an arrow C.

The second slider 104 is provided with a pair of mirrors 104*a* and 104*b* set at an angle of 90 degrees, and is moved by a wire drive mechanism using a fall block in the direction of the arrow C at half a speed at which the first slider 103 travels.

In the case of scanning of an original image on a document sheet manually placed on the second scanning glass 102 (the mirror scanning method), the first slider 103 emits light from the linear light source 103*a* toward the document sheet placed on the second scanning glass 102 while sliding in the direction of the arrow C.

Since the second slider 104 provided with the second mirror 104*a* and the third mirror 104*b* slides in the direction of the arrow C at half the speed at which the first slider 103 travels, an optical distance between a document surface and the collective lens 105 is maintained constant. As a result, an original image on the document sheet placed on the second scanning glass 102 focuses at the line sensor 106 via the collective lens 105.

On the other hand, in the case of scanning of an original image on a document sheet conveyed on the first scanning glass 101 by the document conveying unit 11 (the sheet-through method), the first slider 103 is kept at a position at which the linear light source 103*a* can emit light from just under the first scanning glass 101 toward the document sheet, as illustrated in FIG. 1.

The line sensor 106 converts incident light reflected off the document sheet into electrical signals, and outputs the electrical signals to the control unit 50.

(2) Printing Unit

The printing unit B includes an image forming unit 20, a paper feeding unit 30, a fixing unit 40, and a control unit 50. The image forming unit 20 includes an intermediate transfer belt 22 and process units 23Y, 23M, 23C, and 23K. The intermediate transfer belt 22 is driven to rotate in a direction of an arrow D by a drive source (not illustrated). The process units 23Y, 23M, 23C, and 23K are lined up, under the intermediate transfer belt 22, along a horizontally-moving portion of the intermediate transfer belt 22.

The process units 23Y, 23M, 23C, and 23K form toner images of Y (yellow), M (magenta), C (cyan), and K (black) colors, respectively.

These process units 23Y-23K have similar structures except for a color of toner housed therein. Therefore, description is made only on the structure of the process unit 23K.

The process unit 23K includes a photoreceptor drum 24K, as well as a charging unit 25K, an exposing unit 26K, and a developing unit 27K that surround the photoreceptor drum 24K.

A circumferential surface of the photoreceptor drum 24K is uniformly charged by the charging unit 25K.

The exposing unit 26K performs modulation driving of a laser light source based on image data acquired by the image reading unit A, and performs exposure scanning on the charged surface of the photoreceptor drum 24K. As a result, an electrostatic latent image is formed on the circumferential surface of the photoreceptor drum 24K.

The electrostatic latent image is developed by the developing unit 27K by using black toner.

A primary transfer roller 28K is provided above the photoreceptor drum 24K with the intermediate transfer belt 22 therebetween.

An electric field is formed between the primary transfer roller 28K and the photoreceptor drum 24K. The action of the electric field transfers the toner image formed on the photoreceptor drum 24K onto the intermediate transfer belt 22.

Primary transfer rollers 28Y, 28M, and 28C are respectively provided above the other process units 23Y, 23M, and 23C with the intermediate transfer belt 22 therebetween, and toners images of Y, M, and C colors formed on the photoreceptor drums included in the respective process units 23Y, 23M, and 23C are transferred onto the intermediate transfer belt 22. A full-color image is formed by transferring the toner images of Y, M, C, and K colors onto the same position on the intermediate transfer belt 22 so that the toner images overlap one another.

The toner image transferred onto the intermediate transfer belt 22 is conveyed to a secondary transfer position 21*a* facing a secondary transfer roller 2'1 by a rotational motion of the intermediate transfer belt 22.

Meanwhile, the paper feeding unit 30 picks up recording sheets S contained in a paper feed cassette 31, and feeds the recording sheets S to the secondary transfer position 21*a* one at a time.

A stack of the recording sheets S is placed on a lift plate 32 swingably supported about a support shaft 32*a*. A cam plate 33 is driven to rotate by a drive source (not illustrated) to move the lift plate 32 up so that a surface of a recording sheet S at the top of a sheet stack is brought into contact with a circumferential surface of a pick-up roller 34.

The recording sheets S picked up by rotation of the pick-up roller 34 are separated from each other when the recording sheets S pass a nip (separation nip) formed between a feeding roller 35 and a separation roller 36.

The recording sheets S separated at the separation nip are vertically conveyed via a vertical conveyance roller pair 37 to a registration roller pair 38 located downstream in a sheet conveyance direction (hereinafter, upstream and downstream in a direction in which a recording sheet is conveyed are simply referred to as "upstream" and "downstream", respectively).

A reference sign 201 indicates a timing sensor included in the vertical conveyance unit. The timing sensor 201 is, for example, a reflective photoelectric sensor including a light-emitting element and a light-receiving element that detects light emitted from the light-emitting element and reflected off the recording sheet. The timing sensor is used to detect a front end and a rear end of the recording sheet S at a detection position.

The control unit 50 judges that the front end of the recording sheet S has passed through the detection position when a detection signal of the timing sensor 201 turns from OFF to ON, and judges that the rear end of the recording sheet S has passed through the detection position when the detection signal of the timing sensor 201 turns from ON to OFF.

Rotation of the registration roller pair 38 is stopped at first. After the timing sensor 201 detects the front end of the recording sheet S, the vertical conveyance roller pair 37 continues conveying the recording sheet S for a predetermined time period. As a result, a loop is formed between the vertical conveyance roller pair 37 and the registration roller pair 38, and the front end of the recording sheet S is aligned along the nip of the registration roller pair 38 by stiffness of the recording sheet S.

By then forwarding the recording sheet S by rotating the registration roller pair 38 at a predetermined timing, the recording sheet S with skew (oblique motion) corrected is conveyed to the secondary transfer position 21*a* located further downstream than the registration roller pair 38, and a full-color toner image is transferred onto the recording sheet S.

The recording sheet onto which the toner image is transferred is thermally fixed by the fixing unit 40.

Figure 2:
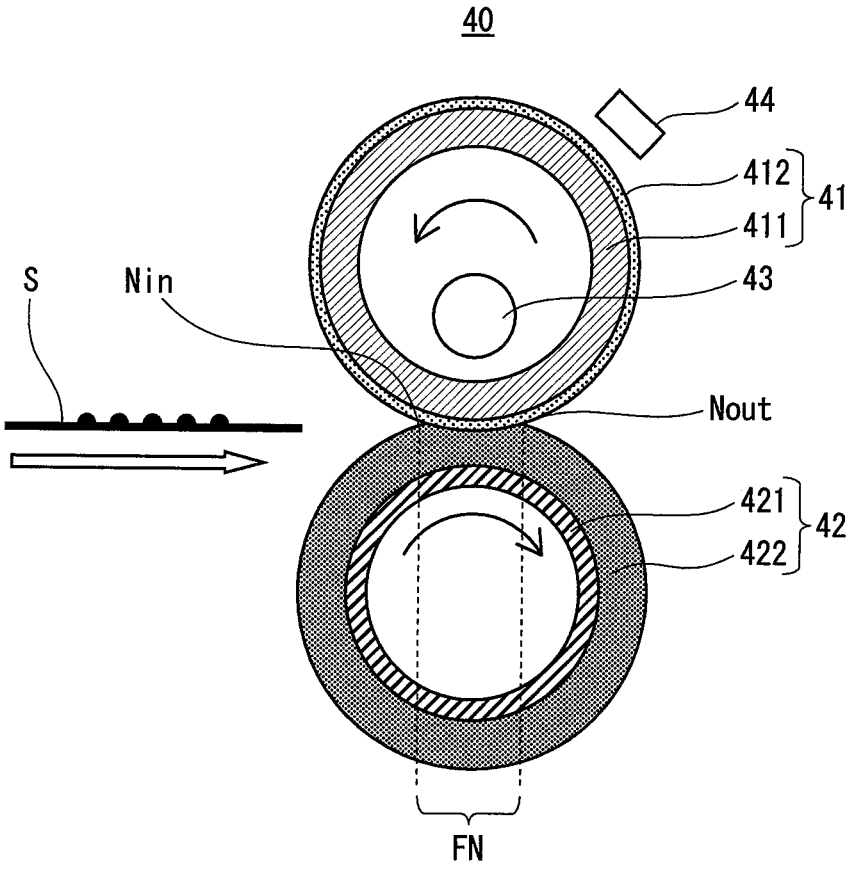
FIG. 2 is a schematic sectional view showing the structure of a principal part of a fixing unit included in the above-mentioned copying machine.

FIG. 2 is a schematic sectional view showing a principal part of the fixing unit 40.

As illustrated in FIG. 2, the fixing unit 40 includes a heating roller 41, a pressing roller 42, a halogen heater 43, and a temperature sensor 44.

The heating roller 41 includes a cored bar 411 that is made of aluminum and is hollow, and an elastic layer 412 that is made of a resin having a high heat resistance, such as silicone rubber, and is formed around the cored bar 411. A fluororesin layer (not illustrated) is further laminated on a circumferential surface of the elastic layer 412 as a release layer. The halogen heater 43 is inserted, as a heating means, into the cored bar 411 along an axial direction of the cored bar 411.

The pressing roller 42 includes a cored bar 421 that is made of aluminum and is cylindrical, and an elastic layer 422 that is made of silicone rubber and is formed around a circumferential surface of the cored bar 421. The pressing roller 42 is pressed against the heating roller 41 by a spring and the like (not illustrated) to form a fixing nip FN having a predetermined width.

The temperature sensor 44 is provided to measure the temperature of a circumferential surface of the heating roller 41. A non-contact type thermistor or an infrared sensor is used as the temperature sensor 44, for example.

The control unit 50 controls power supplied to the halogen heater 43 based on the detection result of the temperature sensor 44 so that the temperature of the circumferential surface of the heating roller 41 (hereinafter, simply referred to as the "temperature of the heating roller 41") becomes equal to a target fixing temperature (temperature control).

The heating roller 41 and the pressing roller 42 are each rotatably supported, via bearing members, by frames (not illustrated) at both ends in an axial direction thereof (corresponding to a direction perpendicular to the plane of FIG. 2). The heating roller 41 is driven by a drive source (not illustrated) to rotate in a direction of an arrow in FIG. 2, and the pressing roller 42 passively rotates as the heating roller 41 rotates.

Referring back to FIG. 1, the recording sheet onto which the toner image is fixed after passing through the fixing nip FN of the aforementioned fixing unit 40 is ejected onto an ejection tray 391 via an ejection roller pair 39.

Toner not transferred onto the recording sheet and remaining on the intermediate transfer belt 22 is removed by a cleaning blade 29.

An operation performed when a color printing mode is executed has been described so far. When monochrome printing, such as printing in black, (a monochrome printing mode) is executed, only the imaging unit 23K for black color is driven, and a black image is formed on the recording sheet through charging, developing, transfer, and fixing with respect to the black color by an operation similar to the operation described above.

An operation panel 70 (not illustrated in FIG. 1, see FIG. 3) is provided at a front and top side of a body of the apparatus so that users can use it easily. The operation panel 70 is equipped with one or more buttons, a touch panel-type liquid crystal display, and the like for receiving instructions from users. The operation panel 70 transmits the received instructions to the control unit 50, and displays information showing a state of the copying machine 1 on the liquid crystal display.

The control unit 50 controls operations of the document conveying unit 11 and the scanning unit 10 included in the image reading unit A, and the image forming unit 20, the paper feeding unit 30, and the fixing unit 40 included in the printing unit B.

(3) Structure of Control Unit 50

Figure 3:
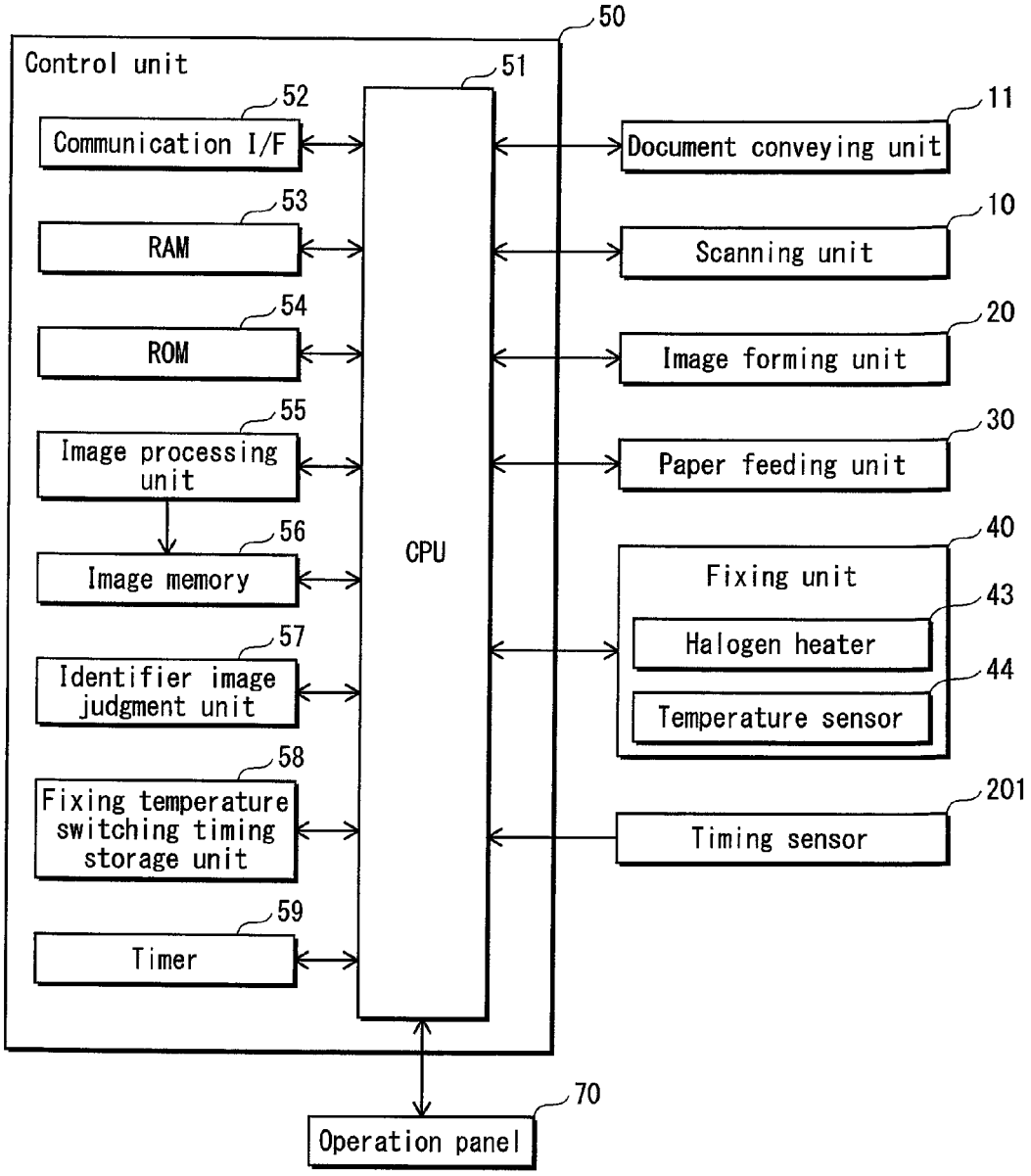
FIG. 3 is a block diagram showing the structure of a control unit in Embodiment 1 of the present invention.

FIG. 3 is a block diagram showing a main structure of the control unit 50.

As shown in FIG. 3, the control unit 50 includes a central processing unit (CPU) 51, a communication interface (I/F) 52, random access memory (RAM) 53, read only memory (ROM) 54, an image processing unit 55, image memory 56, an identifier image judgment unit 57, a fixing temperature switching timing storage unit 58, and a timer 59.

The CPU 51 reads a control program from the ROM 54, and executes the control program by using the RAM 53 as a working storage area at power-on of the copying machine 1.

The CPU 51 also receives, through the communication I/F 52, a print job from another terminal via a communication network such as a LAN.

Image data of an original image scanned by the scanning unit 10 or image data included in data of a print job received from an external terminal undergoes known image processing, such as edge enhancement and smoothing, in the image processing unit 55, and are then stored in the image memory 56.

The identifier image judgment unit 57 judges whether there is any identifier image in image data stored in the image memory 56 for each page through search, determines a position of the identifier image, if any, and notifies the CPU 51 of the results of the judgment.

In a fixing operation for each page, the CPU 51 determines, based on information acquired from the aforementioned identifier image judgment unit 57, a timing at which a target fixing temperature is switched so that the temperature of the heating roller 41 reaches a second fixing temperature by the time the identifier image on a recording sheet arrives at the fixing nip FN, and stores the determined timing in the fixing temperature switching timing storage unit 58.

The image memory 56 and the fixing temperature switching timing storage unit 58 described above each include non-volatile memory such as EEPROM (registered trademark), for example.

The timer 59 starts measuring time upon the start of driving of the registration roller pair 38. The CPU 51 switches the target fixing temperature at the timing stored in the fixing temperature switching timing storage unit 58 with reference to the timer 59, and performs temperature control based on values detected by the temperature sensor 44 so that the temperature of the heating roller 41 included in the fixing unit 40 is maintained at the target fixing temperature. Details of the temperature control are described later.

The CPU 51 controls the document conveying unit 11 and the scanning unit 10 included in the image reading unit A to generate image data by scanning an original image, and controls operations of the image forming unit 20 and the paper feeding unit 30 included in the printing unit B based on the image data of the scanned image or image data of a print job received from an external terminal apparatus via the communication I/F 52 to perform copying and printing smoothly.

(4) Temperature Control Processing

The following describes processing to control the temperature of the fixing unit 40 performed by the control unit 50.

(4-1) Overview of Temperature Control Processing

In the present embodiment, when image data targeted for printing includes an identifier image, temperature control is performed so that a toner image of the identifier image is fixed at a temperature higher than a temperature at which a toner image of a text image is fixed.

For example, when an image acquired by scanning a document sheet includes character strings 601 composed of alphabetical letters A-F and QR codes 602 as identifier images as illustrated in FIG. 4, the control unit 50 controls the temperature of the heating roller 41 so that toner images in ranges a1-a5 are fixed at a temperature (a second fixing temperature) higher than a temperature (first fixing temperature) required to fix a toner image of a text image. Here, the ranges a1-a5 are ranges of formation of the QR codes 602 on a recording sheet onto which toner images have been transferred, defined in terms of a direction in which the recording sheet passes through the fixing unit 40 (i.e., a recording sheet conveyance direction).

In the present embodiment, for example, the first fixing temperature is set to 160° C., and the second fixing temperature is set to 170° C., which is 10° C. higher than the first fixing temperature. 170° C. is temperature at which sufficient fixing performance can be obtained with respect to a toner image of the identifier image.

(4-2) Flow Chart of Temperature Control Processing

Figure 5:
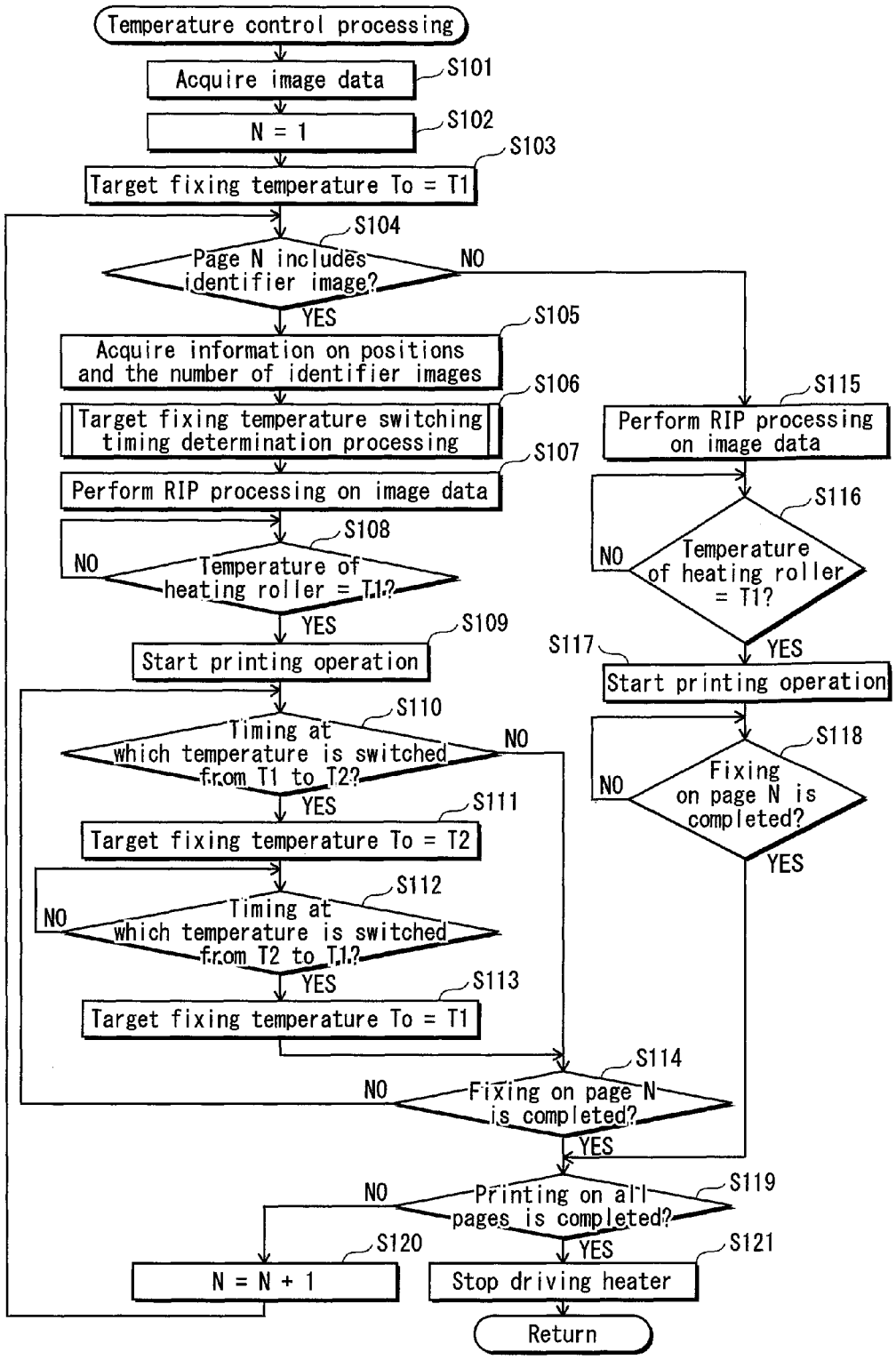
FIG. 5 is a flow chart showing temperature control processing in Embodiment 1.

FIG. 5 is a flow chart showing temperature control processing performed by the control unit 50 in Embodiment 1. This flow chart is a subroutine of a main flow chart (not illustrated) for controlling an overall operation of the copying machine 1.

First, image data targeted for printing is acquired (step S101).

The image data targeted for printing includes image data of a print job received from an external terminal through a LAN or image data acquired by scanning a document sheet by the scanning unit 10.

A variable N indicating a page number is set to a default value "1" (step S102), and a fixing temperature at which the heating roller 41 is to be maintained (a target fixing temperature) To is set to a first fixing temperature T1 (step S103).

Next, the identifier image judgment unit 57 included in the control unit 50 judges whether or not image data on page N, from among the image data as acquired, includes image data of an identifier image (step S104).

For example, when the image data is image data of an original image scanned by the scanning unit 10, an identifier image can be detected based on the scanned original image.

FIG. 9A shows a QR code 600 as a typical example of the identifier image.

As shown in FIG. 9A, the QR code 600 has square position detection patterns 610 at three corners thereof. As shown in FIG. 9B, each of the position detection patterns 610 is represented by a black square 610*b* enclosed by an outer frame 610*a*, and is formed such that black portions and a white portion between the black portions are in a ratio of "1:1:3:1:1" in any of directions D1-D3 in the standards. As a result, positions of the three square patterns 611 are specified, information on whether there are any QR codes 610 having the square patterns at three corners thereof and positions of the QR codes 610, if any, is acquired, and information on the number of the QR codes 610 is acquired by counting the number of the QR codes 610.

Any identifier images other than the QR code have detectable characteristic marks in the standards. The identifier image judgment unit 57 can acquire information on positions and the number of the other identifier images through detection of such characteristic marks from image data.

When the image data is image data included in data of a print job received from an external terminal, the image data is typically received as page description language (PDL) data. The PDL data includes, as control information for printing, information on a type of an image included in each page (a type of an image such as text data and a photo image) and a position thereof. By analyzing the control information, whether there are any identifier images can be judged.

When judging whether there are any identifier images, the identifier image judgment unit 57 temporarily stores the information on positions and the number of the identifier images in the RAM 53 (FIG. 3), for example, via the CPU 51 in association with a page number N on which the identifier images are found. The CPU 51 performs judgment in step S104 in FIG. 5 with reference to the stored information.

When it is judged that any identifier images are included in image data on page N in step S104 (YES in step S104), information on positions and the number of the identifier images on the page is acquired from the RAM 53 (step S105), and processing to determine a timing at which the control unit 50 switches the target temperature of the heating roller 41 during fixing (target fixing temperature switching timing determination processing) is performed (step S106).

Figure 6:
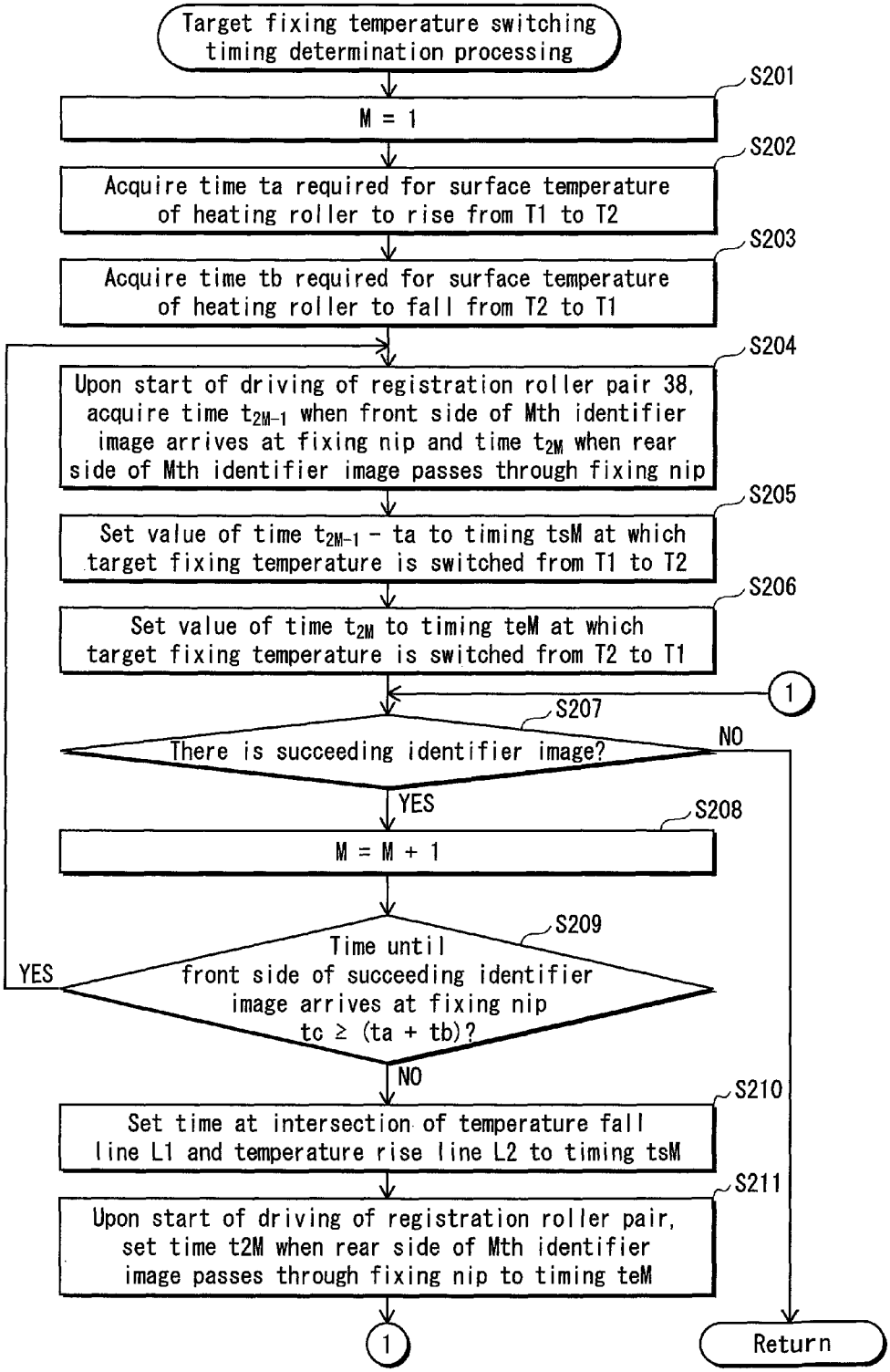
FIG. 6 is a flow chart showing a subroutine of target fixing temperature switching timing determination processing in step S106 in FIG. 5.

FIG. 6 is a flow chart showing a subroutine of the target fixing temperature switching timing determination processing in step S106 described above.

Figure 7:
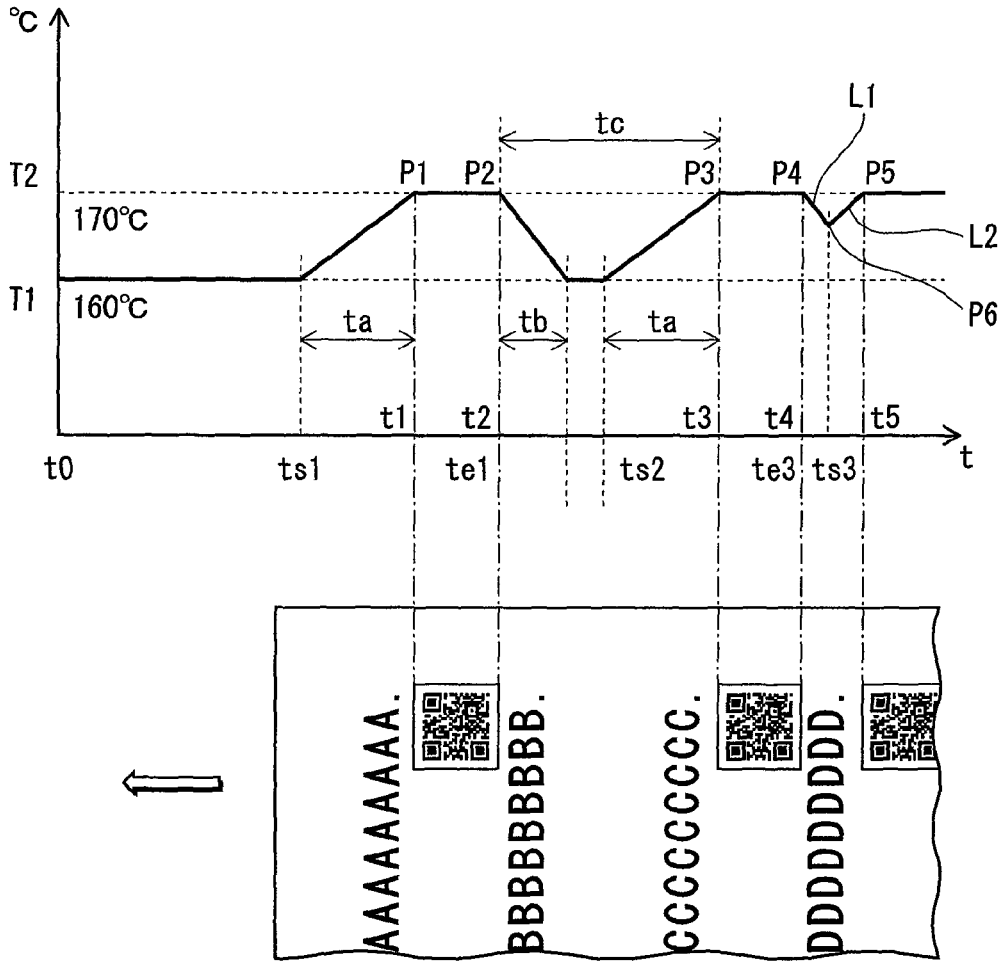
FIG. 7 is a diagram for explaining a specific method for determining a timing in the above-mentioned target fixing temperature switching timing determination processing.

FIG. 7 shows one example of a simulation of a change in the temperature of the heating roller 41 when the target temperature is switched according to the flow chart of FIG. 6.

First, a variable M indicating a position, in a sheet passing direction, of the identifier image in an order of one or more identifier images arranged on the page targeted for printing is set to a default value "1" (step S201).

Then, a time ta required for the temperature of the heating roller 41 to rise from the first fixing temperature T1 (160° C.) to the second fixing temperature T2 (170° C.) is acquired (step S202). A temperature rise rate (temperature rise gradient ka) has preliminarily been acquired from a thermal capability of the halogen heater 43 and a heat capacity of the heating roller 41, and been stored in the ROM 54. The time ta is readily acquired by dividing a temperature difference between T2 and T1 (10° C. in this example) by the temperature rise rate.

Next, a time tb required for the temperature of the heating roller 41 to fall from T2 to T1 is acquired by turning the halogen heater 43 off (step S203). A temperature fall rate (temperature fall gradient kb) has also preliminarily been acquired, and been stored in the ROM 54. The time tb is thus readily acquired by reading the temperature fall rate from the ROM 54, and dividing the temperature difference between T2 and T1 by the temperature fall rate.

Strictly speaking, slight errors in values of the temperature rise gradient ka and the temperature fall gradient kb are caused by the thickness of a recording sheet, the amount of toner actually adhering, the humidity in an apparatus, warmth of the fixing unit, and the like, in addition to the thermal capability of the halogen heater 43. By preliminarily acquiring a range of each of the errors in experiments, adopting, as the value of the temperature rise gradient ka, a value having the minimum absolute value in the range of the value of the temperature rise gradient ka, and adopting, as the value of the temperature fall gradient kb, a value having the maximum absolute value in the range of the value of the temperature fall gradient kb, the temperature of the heating roller 41 can be maintained at the second fixing temperature at least while an identifier image passes through the fixing nip of the fixing unit 40.

Based on the information on the position of the identifier image acquired in step S105 in FIG. 5, time counting is started upon the start of driving of the registration roller pair 38. By using the time when driving of the registration roller pair 38 is started as a criterion time "0", a time $t_{2M-1}$ when the front side of the Mth identifier image arrives at the fixing nip and a time $t_{2M}$ when the rear side of the Mth identifier image passes through the fixing nip are acquired (step S204).

The following describes an example when M=1. When d1 represents a distance, along a conveyance path, between an inlet of the nip of the registration roller pair 38 and an inlet Nin (see FIG. 2) of the fixing nip FN of the fixing unit 40, d2 represents a distance between the front end of the recording sheet in the conveyance direction and the front side of the first identifier image (a value of d2 can be acquired from the information on the position of the identifier image), and v represents a conveyance speed of the recording sheet, the time from the start of driving of the registration roller pair 38 until the front side of the first identifier image arrives at the fixing nip FN can easily be acquired as (d1+d2)/v (see a point P1 in FIG. 7). The time (d1+d2)/v should be set to a time t1.

When d3 represents a distance, along the conveyance path, between an inlet of the nip of the registration roller pair 38 and an outlet Nout of the fixing nip of the fixing unit 40, and d4 represents a distance between the front end of the recording sheet in the conveyance direction and the rear side of the first identifier image, the time from the start of driving of the registration roller pair 38 until the rear side of the first identifier image passes through the fixing nip FN can similarly be acquired as (d3+d4)/v (see a point P2 in FIG. 7). The time (d3+d4)/v should be set to a time t2.

The criterion time is not limited to the above-mentioned time when driving of the registration roller pair 38 is started, and may be any time that can be used as a criterion for specifying a timing at which the fixing temperature is switched.

A value of a time ($t_{2M-1}$−ta) acquired by subtracting the time ta required for temperature rise from the time $t_{2M-1}$ required for the front side of the Mth identifier image to arrive at the fixing nip FN is set to a timing tsM at which the target fixing temperature is switched from T1 to T2 (step S205).

If ($t_{2M-1}$−ta)<0, a time that is the time (ta−$t_{2M-1}$) earlier than the timing at which driving of the registration roller pair 38 is started is set to the timing tsM.

By performing temperature control such that the target fixing temperature is switched to T2 at the timing tsM, the temperature of the heating roller 41 reaches T2 by the time the front side of the Mth identifier image arrives at the fixing nip FN (see the point P1 in FIG. 7). By setting the timing at which the target fixing temperature is switched as described above, the temperature of the heating roller 41 reaches T2 at approximately the same time as the time when the front side of the identifier image arrives at the fixing nip FN, thereby maintaining the performance to fix the identifier image while increasing a power saving efficiency. Of course, when the temperature of the heating roller 41 reaches T2 at least before the front side of the identifier image arrives at the fixing nip FN, there is no problem with the fixing performance, and some degree of power saving efficiency can be obtained.

The above-mentioned time $t_{2M}$ when the rear side of the Mth identifier image passes through the fixing nip is set to the timing teM at which the target fixing temperature is switched from T2 to T1 (step S206). Because the target fixing temperature is not required to be maintained at T2 after the rear side of the Mth identifier image passes through the fixing nip FN, the target temperature is immediately switched to T1 for saving power (see the point P2 in FIG. 7).

Then, whether there is a succeeding identifier image is judged (step S207). When there is the succeeding identifier image (YES in step S207), the value of M is incremented by one (step S208), and whether the time tc from passage of the rear side of the preceding identifier image through the fixing nip to arrival of the front side of the succeeding identifier image at the fixing nip is equal to or longer than the time ta+tb is judged (step S209).

The time tc can easily be acquired by dividing, by the conveyance speed v of the recording sheet, the value obtained by subtracting the width of the fixing nip FN from the distance between the rear side of the preceding identifier image and the front side of the succeeding identifier image.

When the time tc is equal to or longer than the time ta+tb as with the time between the points P2 and P3 in FIG. 7 (YES in step S209), a time that is the time ta earlier than the time t3 when the front side of the succeeding identifier image arrives at the fixing nip is set to the timing time ts2 in step S204 (step S205), as the temperature of the heating roller 41 falls to T1 before the next switching timing. The timing at which the target fixing temperature T0 is switched from T2 to T1 is determined in step S206.

When the time tc is not equal to or longer than the time ta+tb in step S209 as with the time between the points P4 and P5 in FIG. 7, the target fixing temperature is required to be switched to T2 while the temperature falls from T2 to T1. In this case, a time at an intersection P6 of a temperature fall line L1 passing through the point P4 and a temperature rise line L2 passing through the point P5 is set to the timing at which the target fixing temperature To is switched from T1 to T2 (step S210).

Since coordinates of the points P4 and P5 are respectively (t4, T2) and (t5, T2), and gradients of the temperature fall line L1 and the temperature rise line L2 are respectively kb and ka, the temperature fall line L1 and the temperature rise line L2 can be expressed as follows.

$$\text{Temperature fall line } L1\text{: } T=kb(x-t4)+T2 \quad (1)$$

$$\text{Temperature rise line } L2\text{: } T=ka(x-t5)+T2 \quad (2)$$

By solving the simultaneous equations (1) and (2), values of t coordinates at the intersection of the lines L1 and L2 can easily be acquired.

The time t2M from the start of driving of the registration roller pair until the rear side of the Mth identifier image passes through the fixing nip is set to the timing teM (step S211).

The aforementioned switching timing setting processing is repeated until there is no longer any identifier image on the target page. When there is no longer any identifier image on the target page (NO in step S207), the processing returns to the flow chart of FIG. 5.

FIG. 8 is a table showing a timing at which the target fixing temperature determined as described above is switched (a target fixing temperature switching timing table). The target fixing temperature switching timing table is stored in the fixing temperature switching timing storage unit 58.

In step S107 in FIG. 5, a raster image processor (RIP) processing is performed on image data on page N, and, after it is confirmed that the temperature of the heating roller 41 reaches T1 (YES in step S108), a printing operation is started (step S109).

With reference to the target fixing temperature switching timing table (FIG. 8) created in step S106 described above, at the timing at which the time counted by the timer 59 is equal to the timing at which the target fixing temperature To is switched from T1 to T2 (YES in step S110), temperature control is performed by switching the target fixing temperature To to the fixing temperature T2 (step S111). At the timing at which the target fixing temperature is switched from T2 to T1 (YES in step S112), temperature control is performed by setting the target fixing temperature To to the fixing temperature T1 (step S113).

In step S114, whether or not fixing on page N is completed is judged. The judgment is made based on the size of a recording sheet being used (the size is detected by a well-known size detection sensor (not illustrated) provided to the paper feed cassette 31 or is recognizable by a user's input to the operation panel 70). The judgment is made, for example, by judging whether or not the rear end of the recording sheet has passed through the fixing nip based on the above-mentioned time having elapsed since the start of driving of the registration roller pair 38 or the time having elapsed since the rear end of the recording sheet is detected by a sheet-passage sensor (not illustrated) provided before the fixing nip FN of the fixing unit 40.

When fixing on page N is not completed (NO in step S114), the above-mentioned processing in steps S110 to S113 is repeated.

When it is judged that no identifier image is included in the image data on page N in step S104 (NO in step S104), the target fixing temperature switching timing determination processing is not required to be performed with respect to the page. In this case, the raster image processor (RIP) processing is performed on the image data on page N (step S115), and, after it is confirmed that the temperature of the heating roller 41 reaches T1 (YES in step S116), a printing operation on page N is started (step S117).

Whether or not fixing on page N is completed is judged in step S118.

When it is judged that fixing on page N is completed in the step S114 or S118 described above, whether or not a printing operation on all the pages is completed is judged in step S119.

The number of pages to be continuously printed in a job can be known from the number of pages counted in scanning of document sheets when the image data acquired in step S101 is image data of a copy job, and can be known from control information on data of a print job when the image data is image data of a print job. Therefore, whether or not printing of all the pages is completed can be judged by counting the number of pages printed out.

When printing of all the pages is not completed (NO in step S119), the value of N is incremented by one in step S120, and processing in steps S105 to S114 or processing in steps S115 to 118 is repeated with respect to image data on the succeeding page based on the result of the judgment in step S104.

When printing of all the pages is completed (YES in step S119), driving of the halogen heater 43 is stopped (step S121), and temperature control processing for the job is completed.

As set forth above, the target fixing temperature switching timing shown in the target fixing temperature switching timing table (see FIG. 8) is determined so that the temperature of the heating roller 41 is equal to the second fixing temperature while a toner image in the range of formation of the identifier image is being fixed in step S106. By switching the target fixing temperature with reference to the table in FIG. 8, a toner image of the identifier image can be fixed at the second fixing temperature, and deterioration of the fixed image is prevented. Control is performed by switching the target fixing temperature to the first fixing temperature when a toner image in a range other than the range of formation of the identifier image is fixed, contributing to power saving.

Embodiment 2

In Embodiment 1 described above, description is made on a case where the identifier image has already been included in print data of an original image. In Embodiment 2, description is made on a case where the copying machine 1 has a function to generate the identifier image by itself by coding predetermined information, and to add the generated identifier image to the original image.

Such information to be coded includes an optimum image forming condition set by a user, attribute information of a user who issues a job, a password for a login and other security information, a printing date and time, a serial number of an apparatus that executes printing, and an URL of a Web site.

A security function using a QR code and having compatibility has particularly been proposed in recent years, and there has been increasing demand for addition of an identifier image to an original image during printing.

The overall structure of the copying machine 1 in the present embodiment is the same as that in Embodiment 1. The present embodiment differs from Embodiment 1 in the structure of the control unit 50 and a part of the temperature control processing.

(1) Control Unit 50

Figure 10:
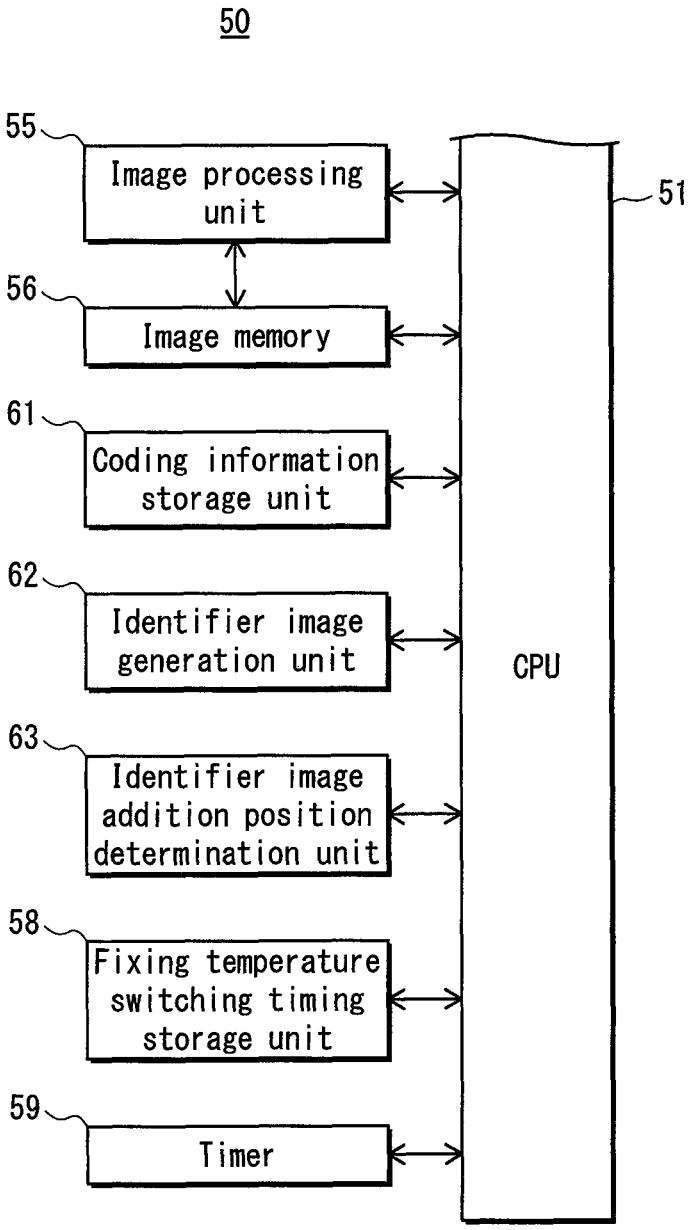
FIG. 10 is a block diagram showing the structure of a control unit in Embodiment 2 of the present invention.

FIG. 10 is a diagram for explaining differences between the control unit 50 in the present embodiment and the control unit 50 in Embodiment 1.

As shown in FIG. 10, the control unit 50 in the present embodiment includes a coding information storage unit 61, an identifier image generation unit 62, and an identifier image addition position determination unit 63, in place of the identifier image judgment unit 57.

The coding information storage unit 61 stores therein information to be coded to generate an identifier image on each page to be printed or on a particular page.

Such information to be coded includes attribute information of a user, a password, a printing date and time, and a serial number of the copying machine 1 as described above.

The identifier image generation unit 62 reads the information to be coded from the coding information storage unit 61, and performs coding processing specified in the standards of the identifier image to generate image data of the identifier image.

The identifier image addition position determination unit 63 determines a position at which the identifier image as generated above is to be added on a page to which the identifier image is to be added.

The fixing temperature switching timing storage unit 58 stores the target fixing temperature switching timing determined by the CPU 51 in the form of a table based on the addition position as determined above.

(2) Temperature Control Processing (2-1) Overview of Temperature Control Processing FIGS. 11A to 11C show one example of an operation performed in the present embodiment.

First, an identifier image generated by the copying machine 1 coding predetermined information is added to original image data as illustrated in FIG. 11A to generate image data as illustrated in FIG. 11B. Then, target fixing temperature switching control is performed so that a toner image in a range a0 of formation of the identifier image defined in terms of a sheet-passage direction is heated at the second fixing temperature as illustrated in FIG. 11C.

FIG. 11B shows just one example of the position at which the identifier image is to be added. In actuality, a position with an optimum heating efficiency is determined as the addition position, and the identifier image is added at the determined addition position.

(2-2) Flow Chart of Temperature Control Processing

Figure 12:
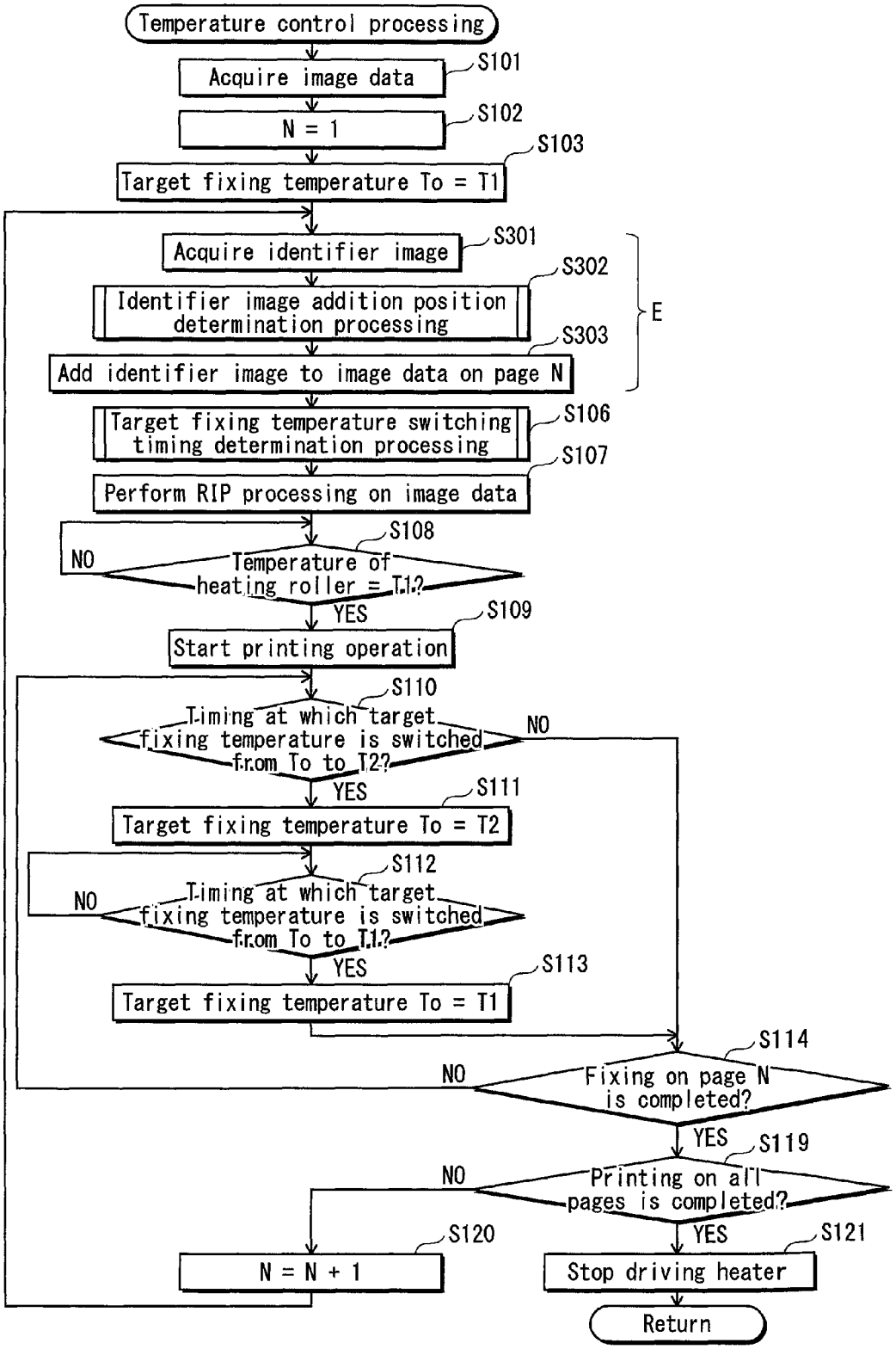
FIG. 12 is a flow chart showing temperature control processing in Embodiment 2.

FIG. 12 is a flow chart showing the temperature control processing performed by the control unit 50 in a case where one identifier image is added to each page of a print job to be executed. The flow chart of FIG. 12 differs from the flow chart of FIG. 5 in Embodiment 1 in processing in steps S301 to S303 in a range E in FIG. 12. In the following description, explanation is made particularly on this point.

After acquisition of image data (step S101), the variable N indicating a page number is set to a value "1", and the target fixing temperature T0 is set to the first fixing temperature T1 (steps S102, S103).

An identifier image to be added to an image on page N and generated by the identifier image generation unit 62 is then acquired (step S301), and identifier image addition position determination processing to determine a position at which the acquired identifier image is to be added is performed (step S302).

Figure 13:
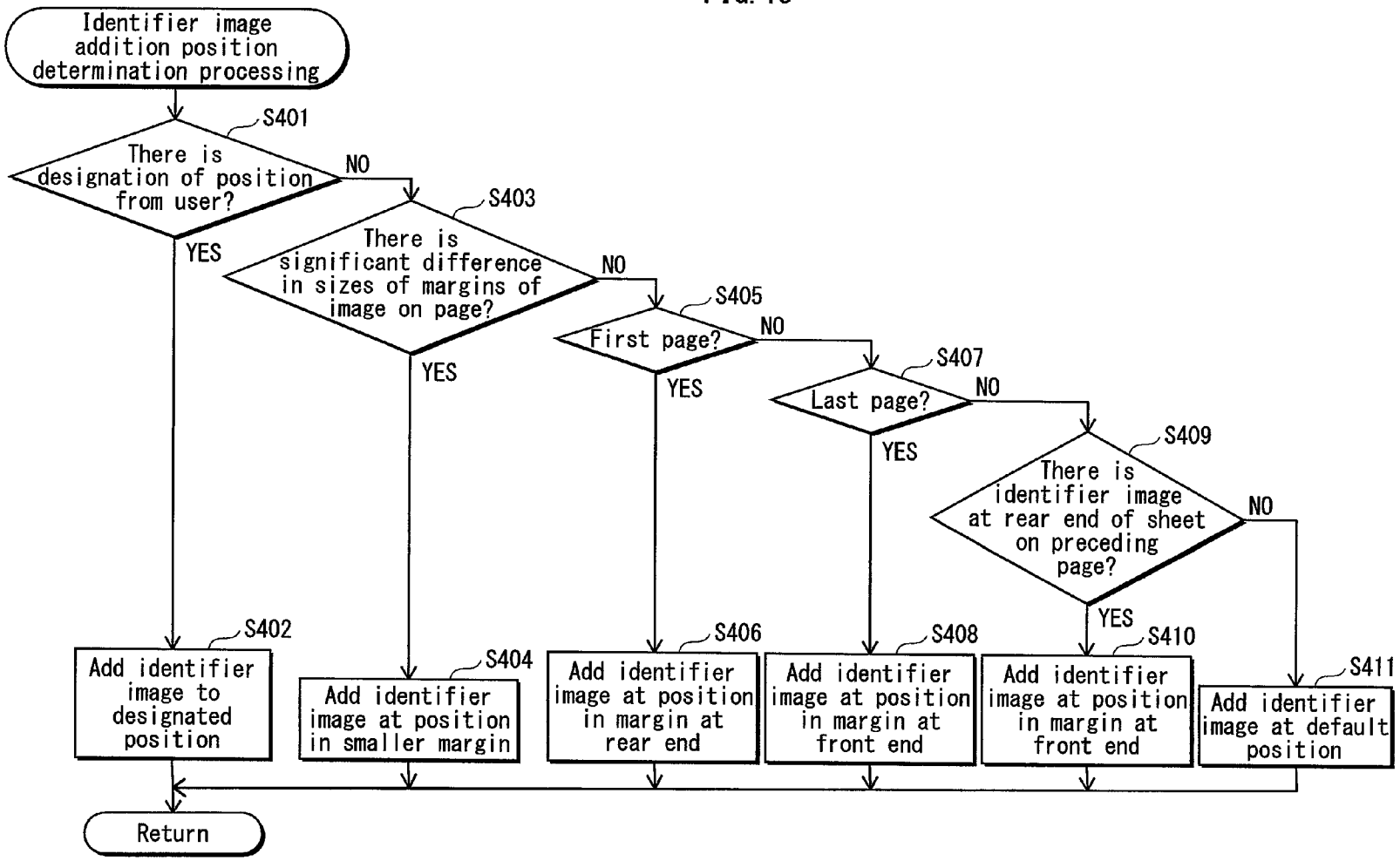
FIG. 13 is a flow chart showing a subroutine of identifier image addition position determination processing in step S302 in FIG. 12.

FIG. 13 is a flow chart showing a subroutine of the identifier image addition position determination processing.

As shown in FIG. 13, in the identifier image addition position determination processing, whether there is a designation of a position at which the identifier image is to be added from a user is judged first (step S401).

The user's designation is made by causing a display unit of the operation panel 70 to display a screen for selecting the addition position, and to allow the user to designate the addition position for each page or for each job so that the addition position is common to all the pages in the job.

For example, the display unit is caused to display icons such as a "right-hand corner in a top margin" and a "right-hand corner in a bottom margin", and to receive a designation from the user upon the user touching any of the icons.

When there is a designation of the identifier image addition position as described above (YES in step S401), the addition position is determined so that the identifier image is added at the designated addition position (step S402).

When there is no designation of the identifier image addition position from the user in step S401 (NO in step S401), whether there is a significant difference in sizes of margins of an image on page N is judged (step S403). When there is a significant difference in sizes of the margins (YES in step S403), the identifier image is added at a position in a smaller margin (step S404).

Figure 14A:
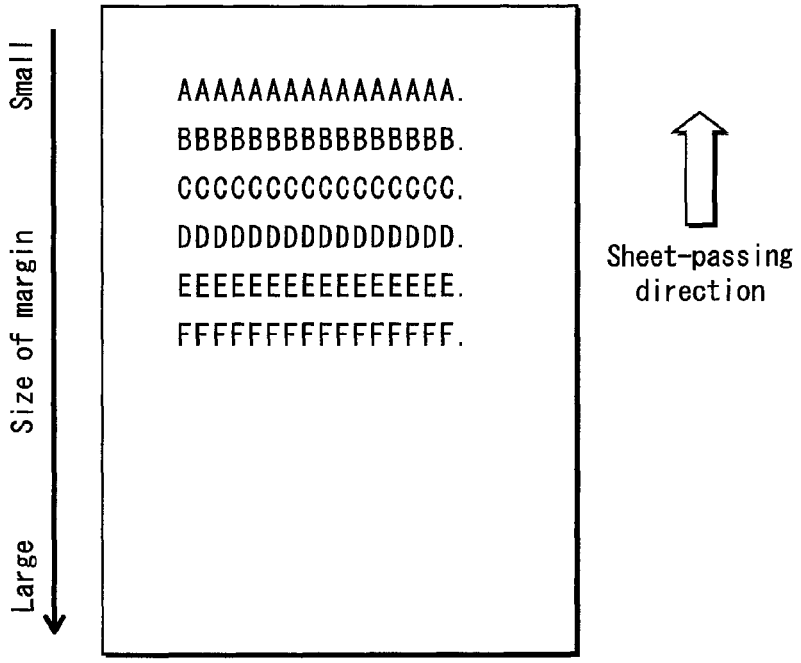
FIGS. 14A and 14B show one example of an identifier image addition position determination method in the above-mentioned identifier image addition position determination processing.
Figure 14B:
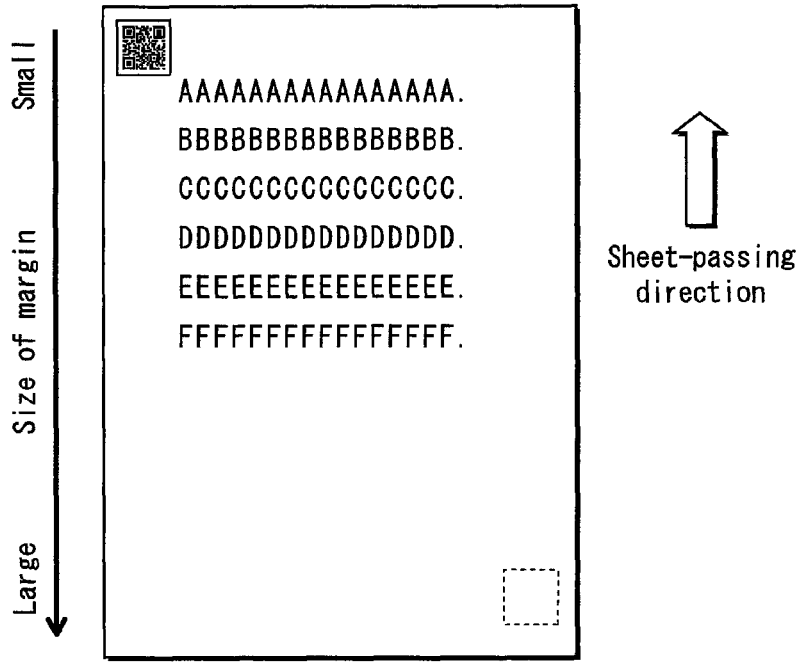

For example, when there is a difference in sizes of the margins of the original image to be printed in the sheet-passage direction as illustrated in FIG. 14A, the identifier image is added at a top position in a smaller margin as illustrated in FIG. 14B (although the identifier image is added to the top left corner in FIG. 14B, the identifier image may be added to the top right corner).

This is because a heating efficiency is higher at the top position than at a bottom position in a larger margin (for example, a position shown as a dashed box in the right bottom corner of FIG. 14B). If the identifier image is to be added at a bottom end position, after decreasing the fixing temperature once, the fixing temperature is required to be increased so as to be equal to the second fixing temperature by the time the identifier image arrives at the fixing nip. This decreases the heating efficiency, and is thus not desirable in terms of saving power.

When there is at least some difference in sizes of the margins, the effect of saving power can be obtained by adding the identifier image at a position in a smaller margin. The present embodiment, however, is limited to the case where "there is a significant difference in sizes of margins" so as not to make control complicated by a frequent switching control.

The expression "there is a significant difference in sizes in margins" means herein that one of the margins in the sheet-passage direction is large enough to form two or more identifier images in the sheet-passage direction, relative to another one of the margins. The degree of the difference may be changed appropriately according to the degree of demand for saving power.

When negative determination is made in step S403, whether or not a page currently targeted for printing is the first page to be passed to the fixing unit 40 is judged (step S405). Even when pages of image data are output in a reverse order from the last page of the image data, the last page corresponds to the "first page" in the present embodiment.

When the page currently targeted for printing is judged to be the first page in step S405 (YES in step S405), an identifier image is added at a position in a margin at the rear end of the page in the sheet conveyance direction (hereinafter, simply referred to as the "rear end") (step S406).

If the identifier image is added at a position in a margin at the front end of the page in the sheet conveyance direction (hereinafter, simply referred to as the "front end"), a printing operation on the first page cannot be started until the temperature rises to be equal to the second fixing temperature after warm-up, and thus a first printing time might be delayed. In contrast, when the identifier image is added at the position in the margin at the rear end, quantity of heat used to perform fixing of a toner image of the identifier image can be used for fixing on the succeeding page, thereby improving the heating efficiency.

When the page currently targeted for printing is judged to be not the first page but the last page to be passed to the fixing unit 40 (NO in step S405 and YES in step S407), an identifier image is added at a position in a margin at the front end. This allows after heat remaining when the temperature falls from the second fixing temperature to the first fixing temperature to be used for fixing, and power supplied to the halogen heater 43 can be turned off during that time period, leading to a high heat use efficiency and power saving.

If the identifier image is added at a position in the margin at the rear end, a job is completed and the halogen heater 43 is turned off in a state where the temperature has been risen to the second fixing temperature. Since after heat remaining when the temperature falls after the temperature is risen to the second fixing temperature cannot be used, the heat use efficiency is low.

When the page currently targeted for printing is neither the first page nor the last page to be passed to the fixing unit 40 (NO in step S407), that is, when the page currently targeted for printing is an intermediate page, whether there is an identifier image at a position in a margin at the rear end of the sheet on the preceding page is judged (step S409).

The judgment is made by sequentially storing the addition positions of the identifier images on respective pages in the RAM 53, for example, and by referring to the stored information regarding the preceding page.

When the identifier image is added at the position in the margin at the rear end of the recording sheet on the preceding page (YES in step S409), the identifier image is added at a position in the margin at the front end of the recording sheet (step S410). As a result, fixing can be performed in a state where the temperature having been risen to the second fixing temperature to fix the identifier image at the rear end of the page on the preceding page is maintained at the second fixing temperature without dissipating heat by decreasing the temperature from the second fixing temperature to the first fixing temperature, leading to a high heat use efficiency.

When the page currently targeted for printing is an intermediate page, and the identifier image is not added at a position in the margin at the rear end of the preceding page (NO in step S409), the identifier image is added at a default position (step S411).

In this case, since there is little difference in the heat use efficiency even when the identifier image is added at any position, the identifier image is added at a position preliminarily set to the image forming apparatus as a default value. This addition position is a position preliminarily set to a position causing no problem in terms of layout (e.g., a top right corner, from among four corners, of the recording sheet as shown in FIG. 11B).

Of course, the image forming apparatus may be programmed such that the addition position is set to a position causing no problem in terms of layout in step S411, an area, other than areas in margins, that does not overlap an image area constituting an original image is detected, and the identifier image is added at an appropriate position from among positions as detected or is added to any of the four corners of the recording sheet if there is not the appropriate position.

When the number of pages targeted for a print job is only one, affirmative determination is made in step S405, and the identifier image is added at a position in the margin at the rear end of the sheet.

Figure 15A:
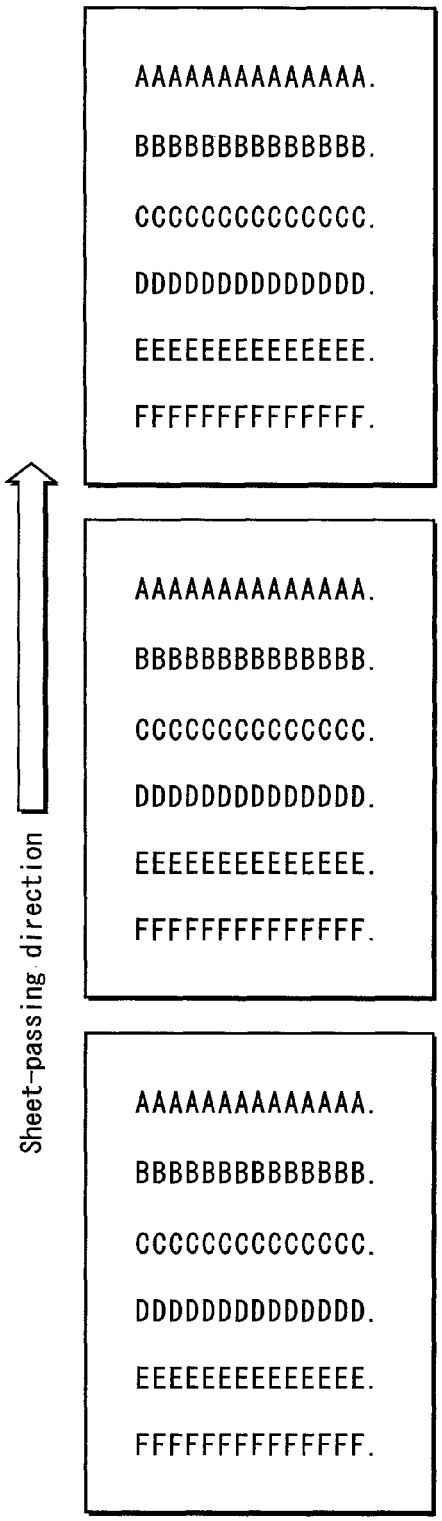
FIGS. 15A and 15B show another example of the identifier image addition position determination method in the above-mentioned identifier image addition position determination processing.
Figure 15B:
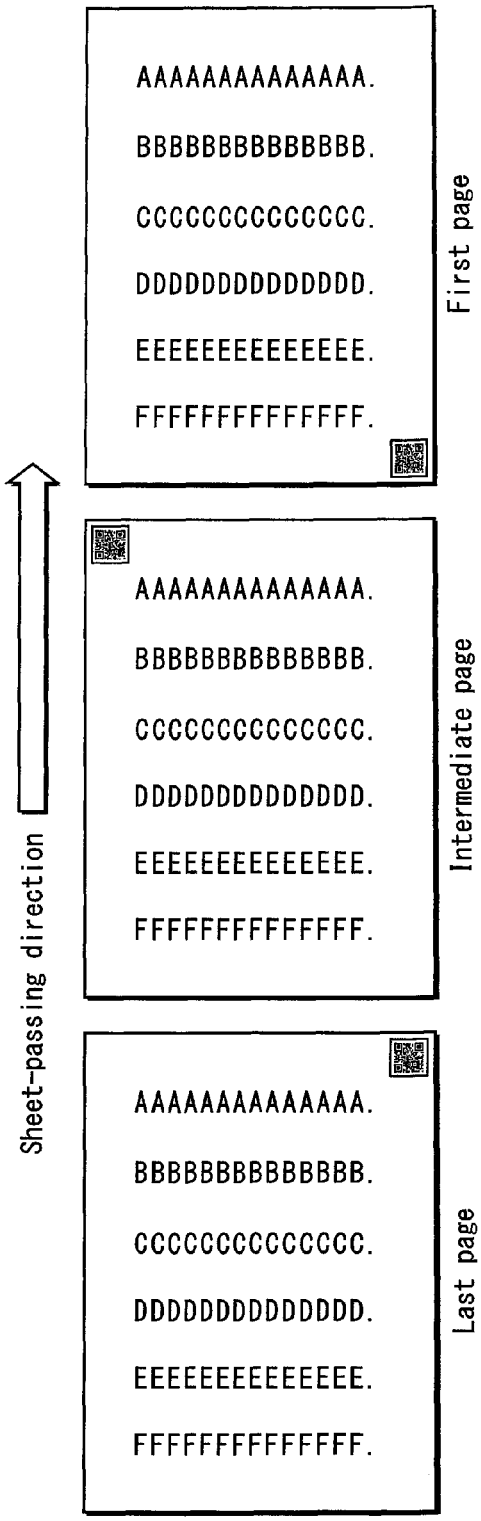

FIGS. 15A and 15B illustrate application of the processing in steps S405-S410 to a case where the number of pages of a print job is three.

FIG. 15A on the left side shows an original image before addition of the identifier image. FIG. 15B on the right side shows an image after addition of the identifier image according to the flow chart of FIG. 13.

As shown in FIG. 15B, as for the first page in the sheet-passage direction, the identifier image is added at a position in the margin at the rear end of the recording sheet (YES in step S405 in FIG. 13, step S406), and, as for the last page in the sheet-passage direction, the identifier image is added at a position in the margin at the front end of the recording sheet (YES in step S407, step S408).

As for the intermediate page, the identifier image is added at a position in the margin at the front end of the recording sheet that is closer to the identifier image addition position on the preceding page (YES in step S409, step S410).

Embodiment 3

In Embodiment 2 described above, description is made on temperature control processing performed when image data targeted for printing includes only a text image and an identifier image. Obviously, high fixing performance is needed when the image data includes, in addition to the text data and the identifier image, a gradation image that is an image having a gradation, such as a photograph and a drawing (in the present embodiment, hereinafter, referred to as a "photo image").

A toner image of a photo image on a page to be printed may be fixed at a temperature that is the same as the second fixing temperature. In the present embodiment, however, description is made on temperature control processing performed when the photo image is fixed at a third fixing temperature that is higher than the second fixing temperature to improve fixing performance of the photo image.

The first, second, and third temperatures are assumed to be 160° C., 170° C., and 180° C., respectively.

(1) Structure of Control Unit 50

Figure 16:
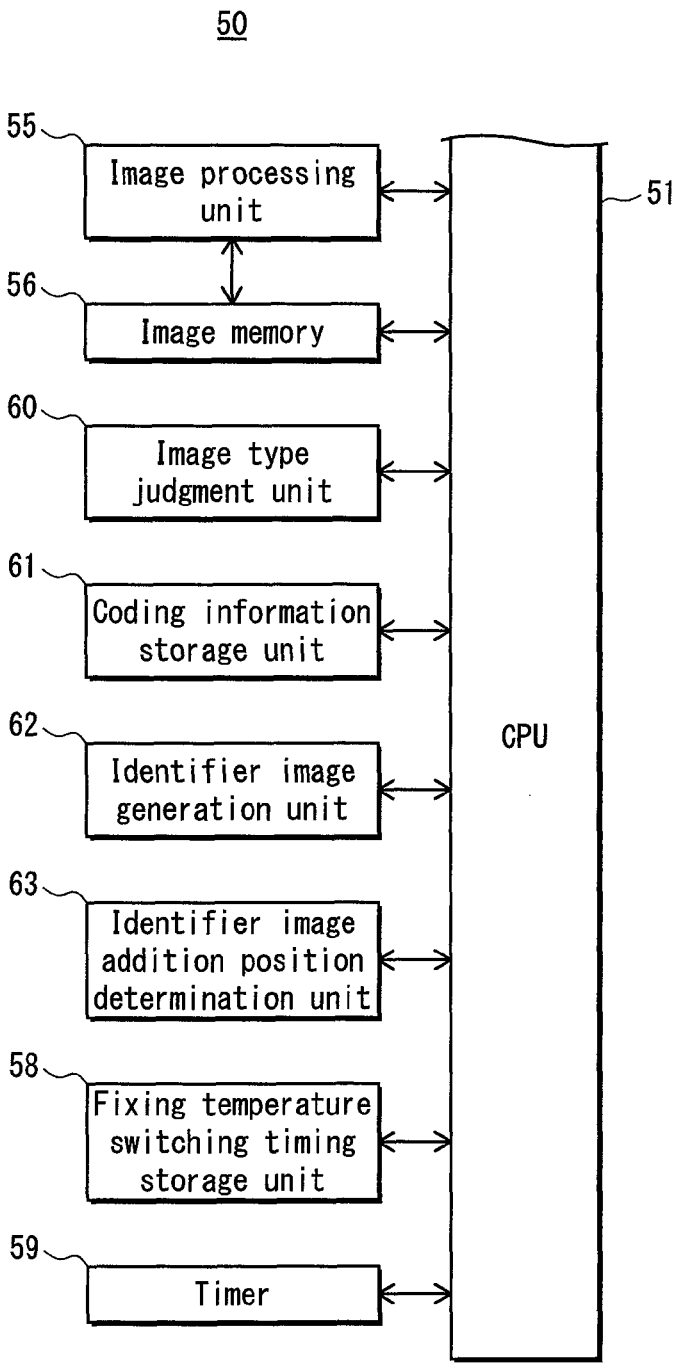
FIG. 16 is a block diagram showing the structure of a control unit in Embodiment 3 of the present invention.

FIG. 16 is a partial view for explaining differences between the control unit 50 included in the copying machine 1 in the present embodiment and the control unit 50 in Embodiment 2.

As shown in FIG. 16, an image type judgment unit 60 is newly added in the present embodiment. The image type judgment unit 60 analyzes image data on a page to be printed, and detects a type (e.g., a text image, a photo image) of an image included in the image data, and a range of formation of the image.

The judgment of the type of the image is made by a known method. For example, when the image data is image data included in data of a print job received from an external terminal, the image data is typically received as page description language (PDL) data. The PDL data includes, as control information for printing, information on a type of an image included in each page (e.g. a text image, a photo image) and a position thereof. By analyzing the control information, information on a type and a position of each image, and the number of images can be acquired.

When the image data is image data of an original image scanned by the scanning unit 10, the image data is scanned in a main scanning direction and/or a sub-scanning direction to count the number of edges. When the number of edges is smaller than a threshold, the image is judged to be a photo image. When the number of edges is equal to or larger than the threshold, the image is judged to be a text image. Alternatively, a density histogram may be created. When the density is biased toward a particular density, the image is judged to be a text image. When the density is not biased toward a particular density, the image is judged to be a photo image.

The control unit 50 performs temperature control processing according to the result of the judgment of the type of the image as described above.

(2) Flow Chart of Temperature Control Processing

Figure 17:
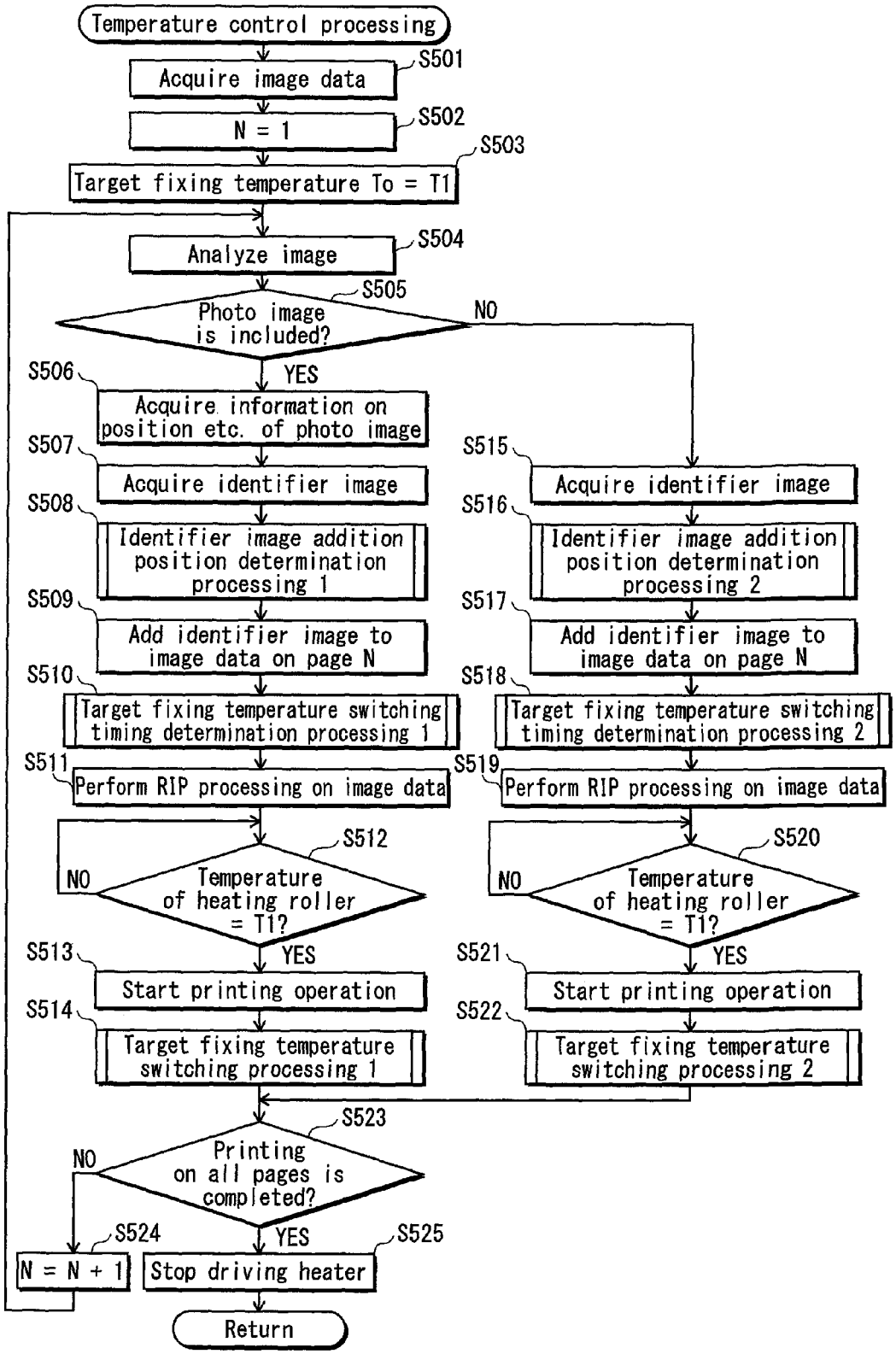
FIG. 17 is a flow chart showing temperature control processing in Embodiment 3.

FIG. 17 is a flow chart showing temperature control processing performed by the control unit 50 in the present embodiment.

First, image data targeted for printing is acquired (step S501).

A variable N indicating a page number is set to a default value "1" (step S502), and a target fixing temperature To at which the temperature of the heat roller 41 is to be maintained is set to a first fixing temperature T1 (step S503).

Next, the image type judgment unit 60 included in the control unit 50 analyzes image data on each page, and acquires information on a type (e.g., a text image, photo image) and a position of an image, and the number of images included in each page (step S504).

The information as acquired is stored in the RAM 53 in association with the page number.

When it is judged that image data on page N includes a photo image as a result of the above-mentioned analysis (YES in step S505), information on a position of the photo image and the number of blocks of the photo image is acquired from the RAM 53 (step S506), an identifier image generated by the identifier image generation unit 62 and to be added to an image on the page is acquired (step S507), and identifier image addition position determination processing 1 is performed to add the identifier image at a position with a high heat use efficiency in terms of the relation to a fixing temperature at another position on the page (step S508).

Figure 18:
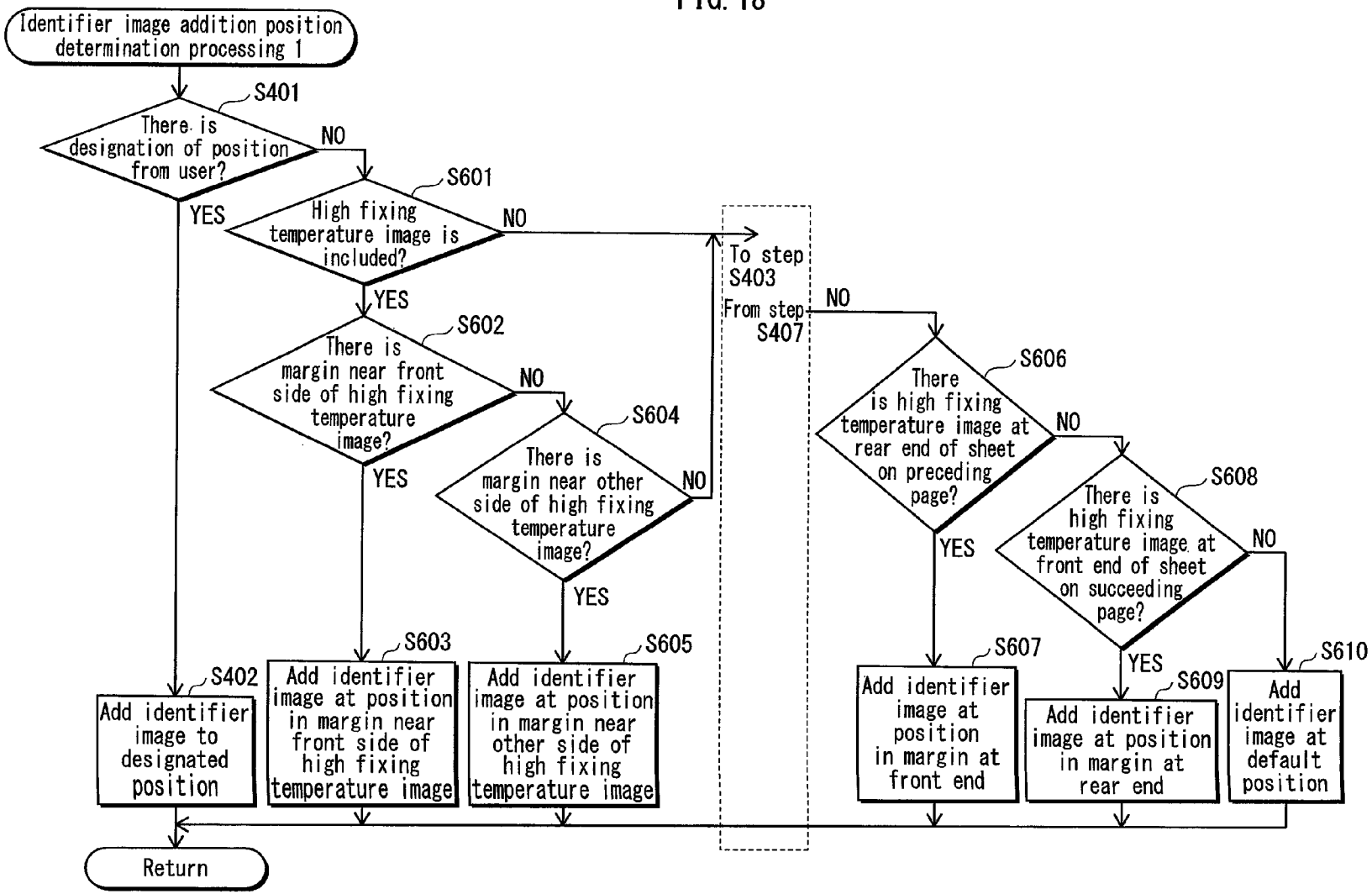
FIG. 18 is a flow chart showing a subroutine of identifier image addition position determination processing 1 in step S508 in FIG. 17.

FIG. 18 is a flow chart showing a subroutine of the identifier image addition position determination processing 1. In order to avoid repetition in explanation, steps that are the same as those in the identifier image addition position determination processing in Embodiment 2 (FIG. 13) are provided with the same step numbers, and steps S403 to S408 are enclosed by a dashed line and description thereof is omitted.

In the identifier image addition position determination processing, whether there is a designation of a position at which the identifier image is to be added from a user is judged first (step S401). When there is the designation of the identifier image addition position (YES in step S401), the addition position is determined so that the identifier image is added at the designated addition position (step S402).

When there is no designation of the identifier image addition position from a user in step S401 (NO in step S401), whether or not an image on the page includes any image (hereinafter, referred to as a "high fixing temperature image", in the present embodiment, however, the high fixing temperature image included in the image on the page is substantially only a photo image, because a case where the identifier image is not included in an original image is supposed) whose toner image is to be fixed at the second fixing temperature or at the third fixing temperature is judged (step S601).

When the high fixing temperature image is not included in the image on the page, processing in and after step S403 in FIG. 13 is performed, as the condition is the same as that in Embodiment 2.

When the high fixing temperature image is included (YES in step S601), whether there is a margin to which the identifier image is to be added near a front side of the high fixing temperature image is judged (step S602).

In the present embodiment, a region "near" a photo image refers to a region in which at least one identifier image can be added with a distance (of approximately 1 mm) from the photo image so that the region is judged to be a region in which a graphics different from the photo image is formed.

When there is the margin near the front side of the high fixing temperature image (YES in step S602), the addition position is determined so that the identifier image is added at a position in the margin (step S603).

Figure 22A:
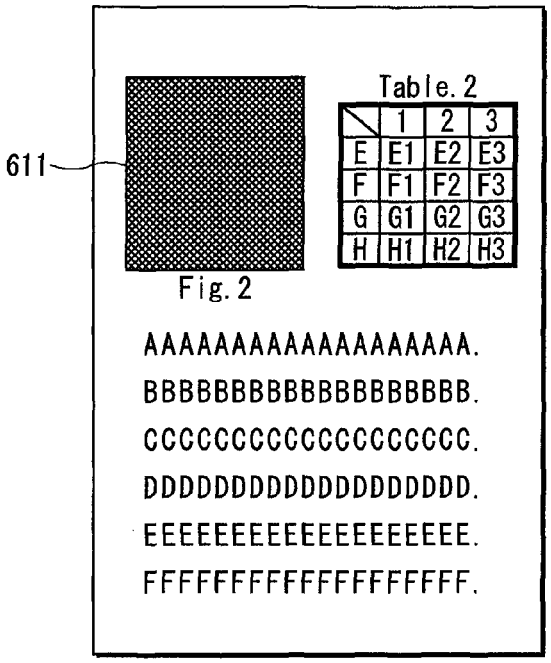
FIGS. 22A and 22B show one example of an identifier image addition position in identifier image addition position determination processing 1 in Embodiment 3.
Figure 22B:
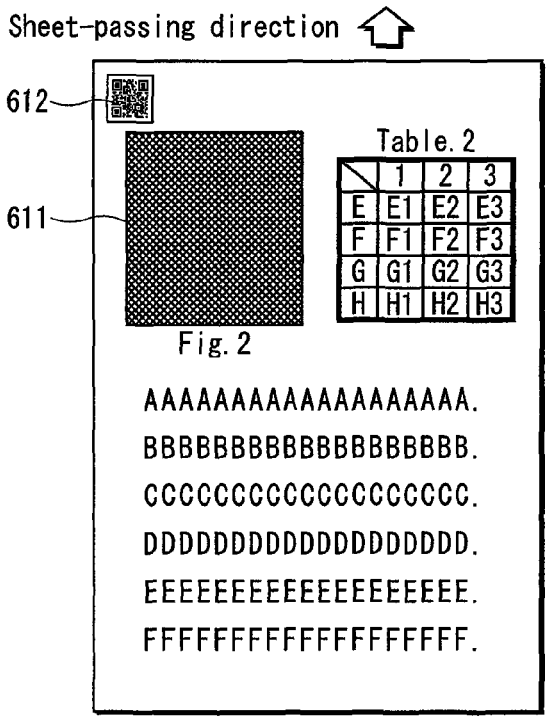

For example, when the original image is as shown in FIG. 22A (the reference sign 611 indicates a photo image), since there is a margin that is large enough to form an identifier image at the front side of the photo image 611, an identifier image 612 is added at a position in the margin at the front side of the photo image 611, as shown in FIG. 22B.

When there is no margin near the front side of the high fixing temperature image in step S602 (NO in step S602), whether there is a margin near the other side of the high fixing temperature image is judged (step S604). When there is the margin near the other side, the addition position is determined so that the identifier image is added at a position in the margin near the other side (step S605).

Figure 23A:
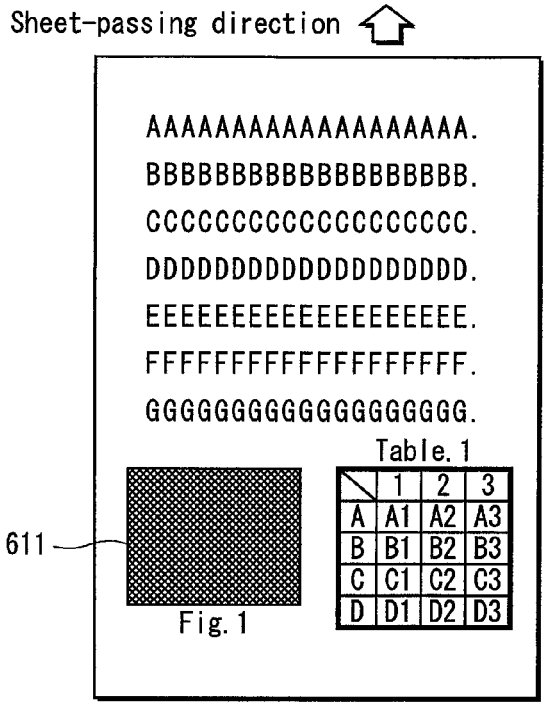
FIGS. 23A and 23B show another example of an identifier image addition position in the identifier image addition position determination processing 1 in Embodiment 3.
Figure 23B:
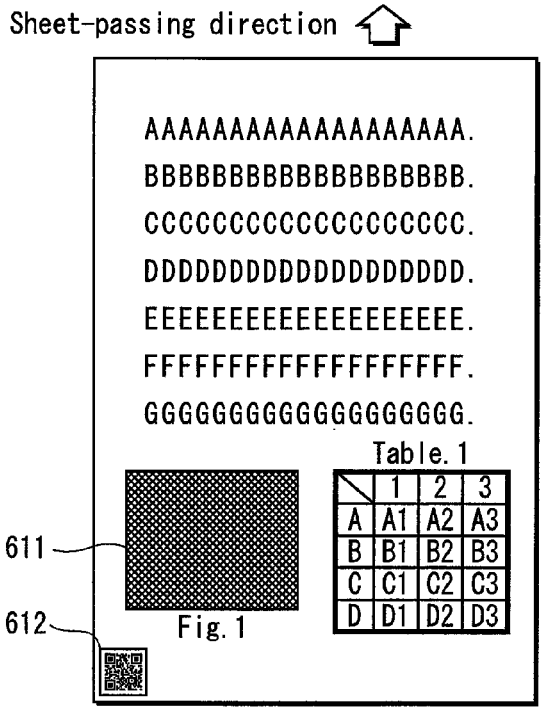

For example, when the original image is as shown in FIG. 23A, since there is no margin for forming an identifier image at the front side of the photo image, but there is a margin that is large enough to form the identifier image at the rear side of the photo image, the identifier image is added at a position in the margin at the rear side of the photo image, as shown in FIG. 23B.

The identifier image is added at a position in the nearest margin to the high fixing temperature image included in the original image, because the temperature of the heating roller 41 is required to be increased to the second fixing temperature or to the third fixing temperature to fix a toner image of the high fixing temperature image, and thus a high heat use efficiency can be obtained when the identifier image is added at a position near the high fixing temperature image.

In particular, the identifier image is added preferentially at a position near the front side of the high fixing temperature image in steps S602 and S603, because, if the identifier image is added at a position near the rear side of the high fixing temperature image (especially, a photo image using a large amount of toner), heat is drawn by fixing of a toner image of the preceding high fixing temperature image, and an expected amount of heat might not be supplied at fixing of a toner image of the identifier image.

When it is judged that there is no margin for forming the identifier image near either side of the high fixing temperature image in step S604 (NO in step S604), processing in and after step S403 (see FIG. 13) is performed as in the case where there is no high fixing temperature image, as the identifier image can no longer be added at a position near the high fixing temperature image.

As described with reference to FIG. 13, when the addition position of the identifier image is determined according to whether or not the page for the image is the first page or the last page of a job in steps S403 to S408, and it is judged that the page is not the last page in step S407 (NO in step S407), whether there is a high fixing temperature image at the rear end of the preceding page is judged in step S606 in FIG. 18. When there is the high fixing temperature at the rear end (YES in step S606), the identifier image is added at a position in a margin at the front end of the succeeding page (step S607).

When it is judged that there is no high fixing temperature image at the rear end of the preceding page in step S606 (NO in step S606), whether there is a high fixing temperature image at the front end of the succeeding page is judged in step S608. When there is the high fixing temperature image at the front end of the succeeding page (YES in step S608), the identifier image is added at a position in the margin at the rear end of the preceding page (step S609).

When negative judgment is made in step S608, the identifier image is added at a default position (step S610).

When the addition position of the identifier image is determined by performing processing in the flow chart of FIG. 18, processing returns to the flow chart of FIG. 17, the identifier image is added at the above-mentioned determined position in the original image (step S509), and the target fixing temperature switching timing determination processing 1 is performed based on arrangement of images after addition of the identifier image (step S510).

Figure 19:
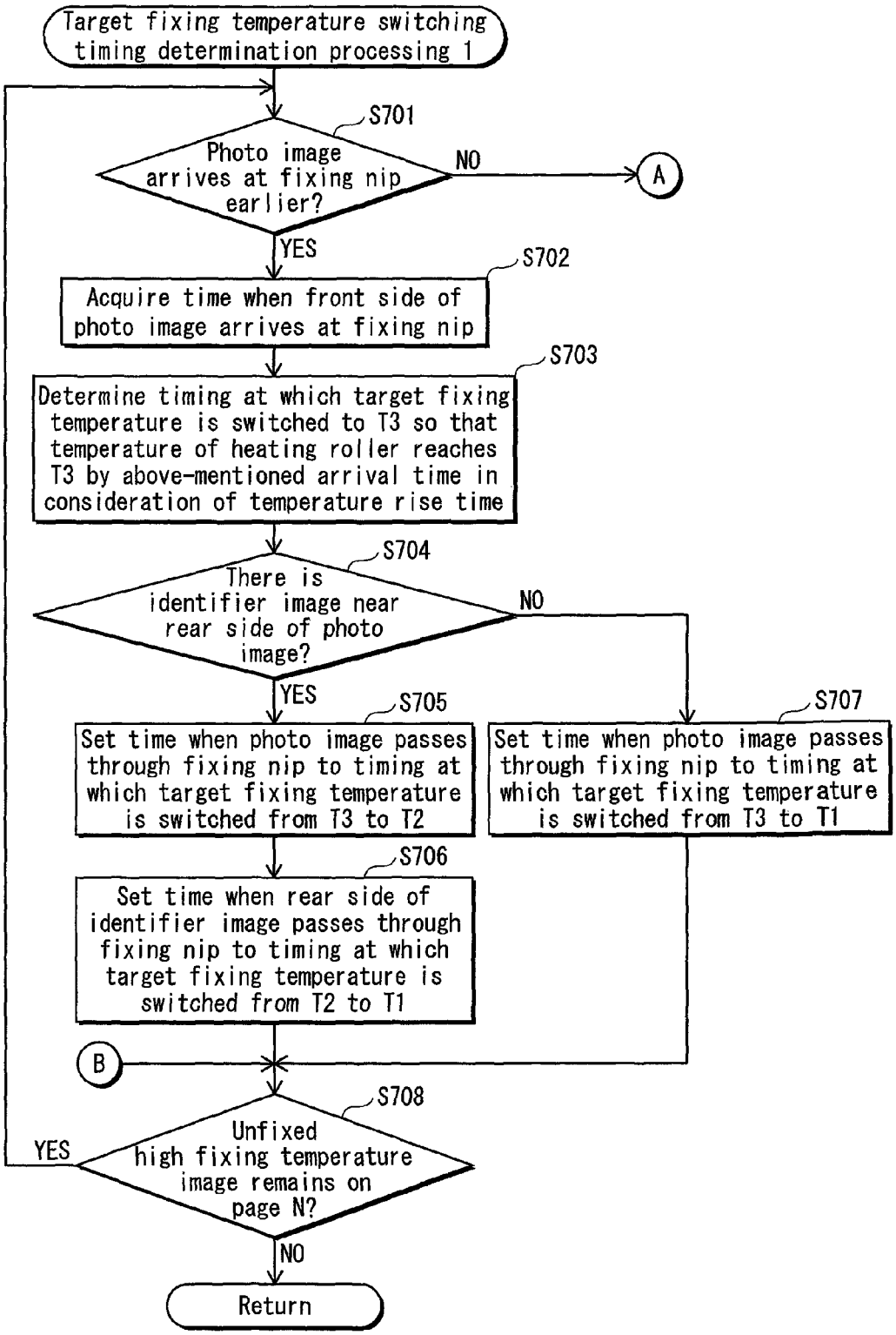
FIG. 19 is a flow chart showing a part of a subroutine of target fixing temperature switching timing determination processing 1 in step S510 in FIG. 17.
Figure 20:
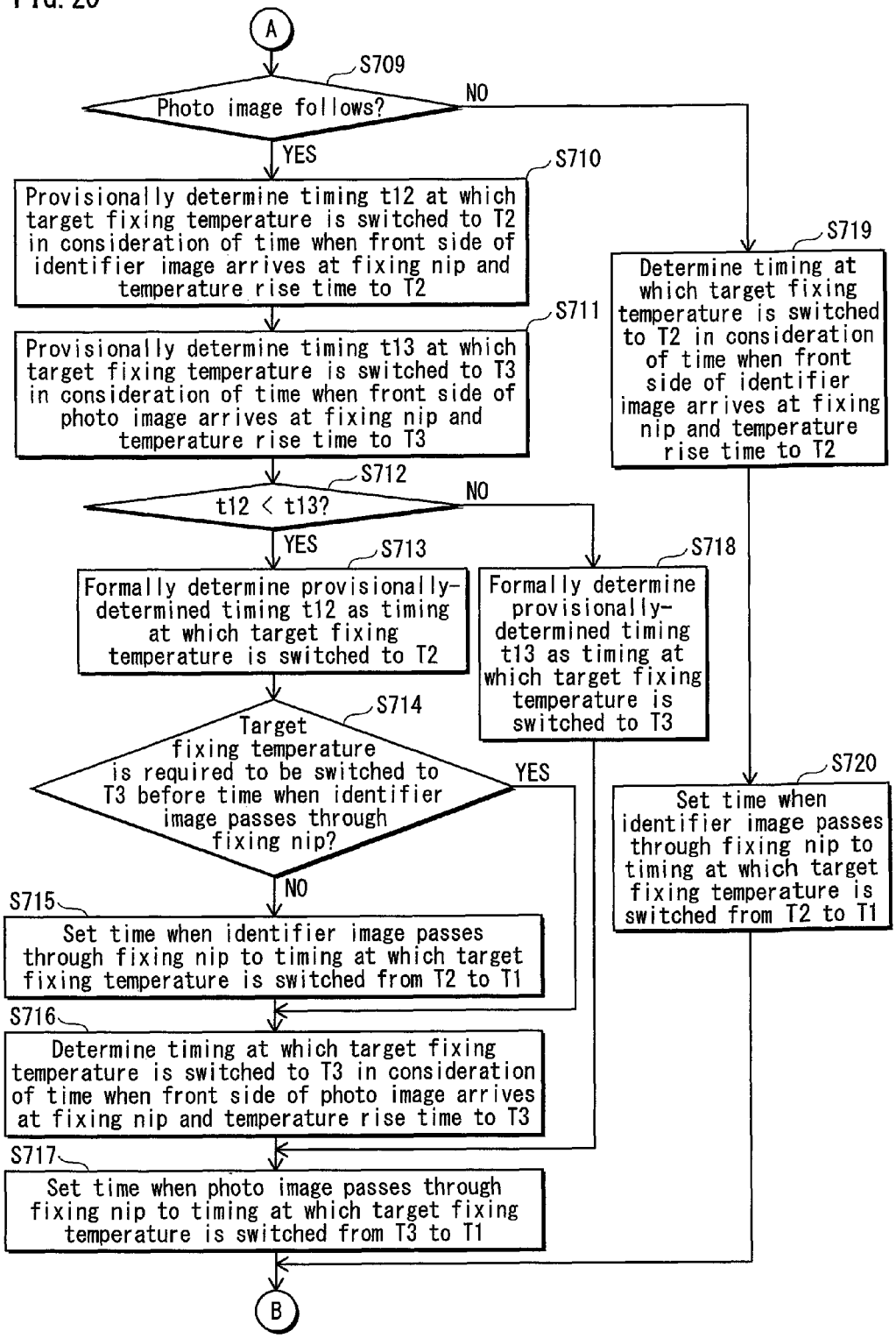
FIG. 20 is a flow chart following the flow chart of FIG. 19.

FIGS. 19 and 20 are each a flow chart showing a subroutine of target fixing temperature switching timing determination processing 1.

First, whether or not a photo image arrives at the fixing nip earlier than an identifier image is judged (step S701). When the photo image arrives at the fixing nip earlier than the identifier image, a time when the photo image arrives at the fixing nip FN is acquired (YES in step S701, step S702), and a timing at which the target fixing temperature is switched to the temperature T3 is determined so that the temperature of the heating roller 41 reaches the temperature T3 by the above-mentioned time the photo image arrives at the fixing nip in consideration of the temperature rise time required for the target fixing temperature to reach the temperature T3 (step S703).

Since the temperature rise gradient ka is known in advance as described above, the temperature rise time can be, acquired by dividing the temperature difference from the target fixing temperature. T3 by the temperature rise gradient ka.

Next, whether there is an identifier image near the rear side of the photo image is judged (step S704). When there is the identifier image near the rear side of the photo image (YES in step S704), a time when the rear side of the photo image passes through the fixing nip is calculated, and the calculated time is set to a timing at which the target fixing temperature is switched from T3 to T2 (step S705). This is because, when there is the identifier image near the rear side of the photo image as described above, it is reasonable to directly switch the target fixing temperature to T2 without switching the target fixing temperature from T3 to T1.

A time when a succeeding identifier image passes through the fixing nip is set to a timing at which the target fixing temperature is switched from T2 to T1 (step S706).

When there is no identifier image near the rear side of the photo image (NO in step S704), the time when the rear side of the photo image passes through the fixing nip FN is calculated, and the calculated time is set to a timing at which the target fixing temperature is switched from T3 to T1 (step S707).

Next, whether there is a high fixing temperature image in a remaining image area on page N is judged (step S708). When there is no longer any high fixing temperature (NO in step S708), processing returns to the flow chart of FIG. 17.

When there is any high fixing temperature image remains (YES in step S708), processing returns to step S701, and whether an image arriving at the fixing nip FN next is a photo image or not is judged. When the photo image arrives at the fixing nip FN earlier (YES in step S701), the above-mentioned processing in steps S702 to S708 is repeatedly performed. When the image arriving at the fixing nip FN next is not the photo image, that is, when the image arriving at the fixing nip FN next is the identifier image (NO in step S701), processing transfers to step S709 in FIG. 20, and whether or not another photo image follows the identifier image is judged.

When there is no photo image following the identifier image (NO in step S709), a timing at which the target fixing temperature is switched from T1 to T2 is determined in consideration of a time when the front side of the identifier image arrives at the fixing nip FN and the temperature rise time required for the target fixing temperature to reach the temperature T2 (step S719). The time when the identifier image passes through the fixing nip FN is set to a timing at which the target fixing temperature is switched from T2 to T1 (step S720).

Figure 24:
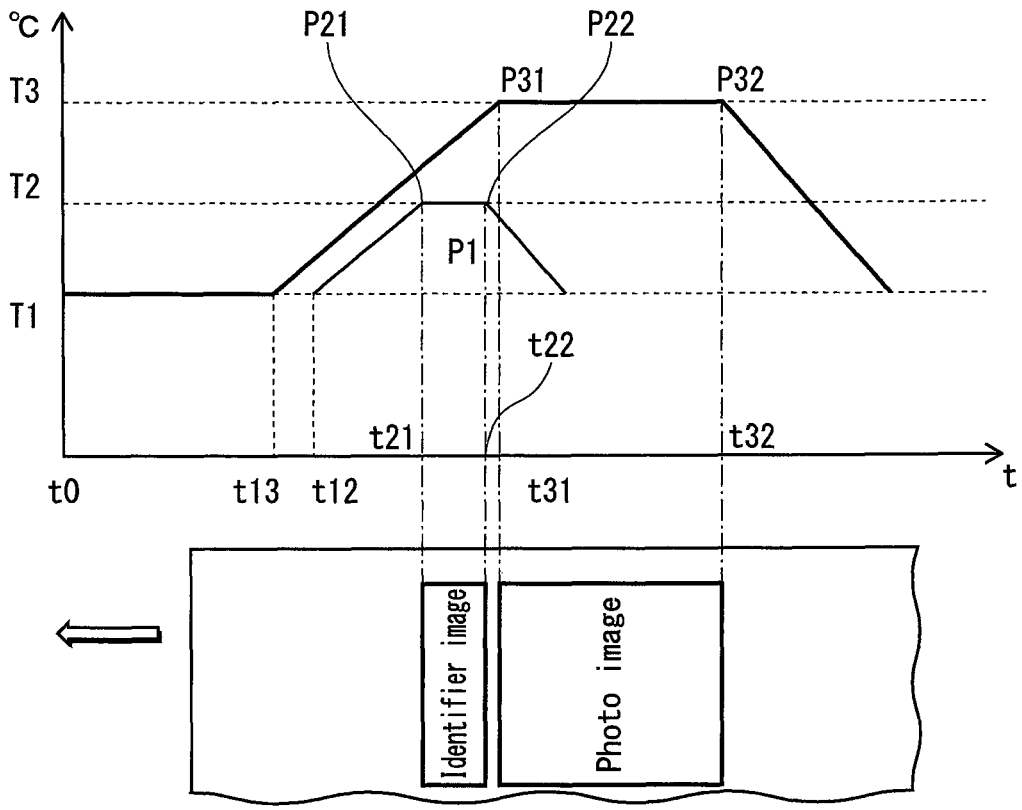
FIG. 24 is a diagram for explaining the first example of a specific timing determination method in the target fixing temperature switching timing determination processing 1 in Embodiment 3.

When it is judged that there is any photo image following the identifier image in step S709 (YES in step S709), a timing t12 at which the target fixing temperature is switched to T2 is provisionally determined in consideration of a time t21 when the front side of the identifier image arrives at the fixing nip FN and the temperature rise time required for the target fixing temperature to reach the temperature T2 (step S710), as shown in a simulation of the temperature change of the heating roller 41 in FIG. 24.

A timing t13 at which the target fixing temperature is switched to the temperature T3 is also provisionally determined in consideration of a time t31 when the front side of the photo image arrives at the fixing nip and the temperature rise time required for the target fixing temperature to reach the temperature T3 (step S711).

Which one of the timing t12 and the timing t13 is earlier than the other is then judged (step S712).

If the provisionally-determined timing t12 is not earlier (see FIG. 24) (NO in step S712), the provisionally-determined timing t13 is formally determined as a switching timing to switch the target fixing temperature directly to the third fixing temperature T3, as the target fixing temperature T3 cannot be increased by the time the succeeding photo image arrives at the fixing nip when the target fixing temperature is switched to the temperature T3 after being switched to the temperature T2 (step S718).

If the provisionally-determined timing t12 is earlier (see FIGS. 25 and 26), the provisionally-determined timing t12 is formally determined as a switching timing to switch the target fixing temperature to the temperature T2 (step S713).

Whether or not the target fixing temperature is required to be switched to the temperature T3 before the time t22 when the identifier image passes through the fixing nip FN is judged (step S714).

Figure 25:
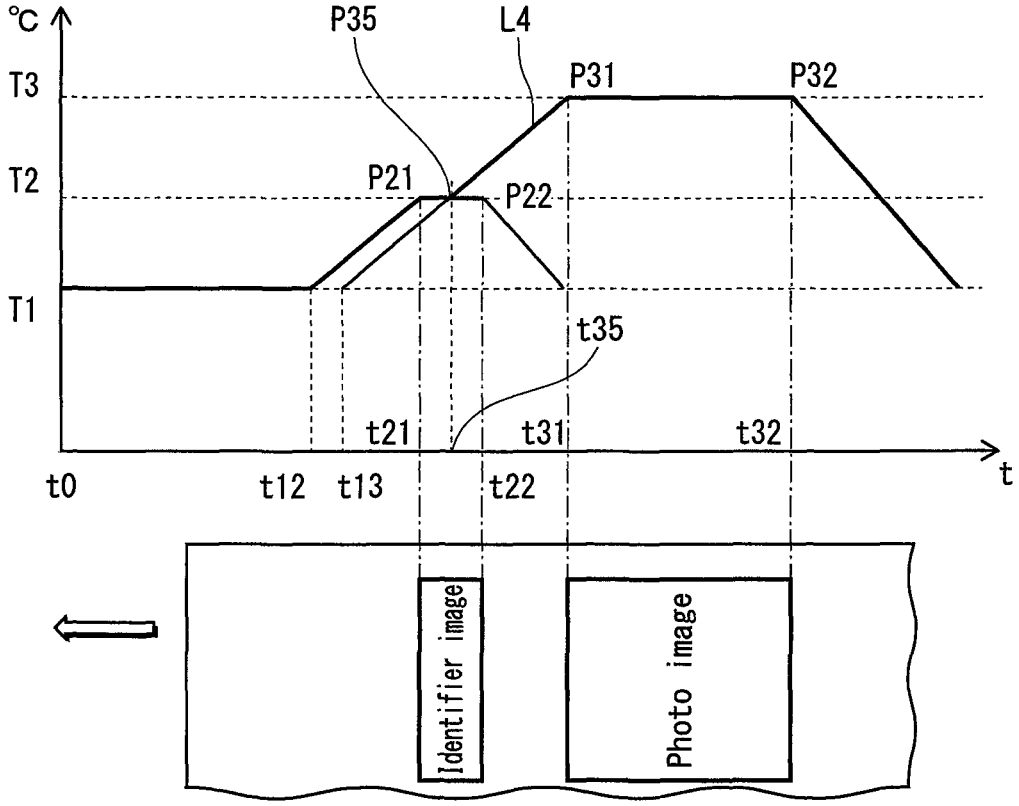
FIG. 25 is a diagram for explaining the second example of the specific timing determination method in the target fixing temperature switching timing determination processing 1 in Embodiment 3.

Specifically, in the case as shown in FIG. 25, the target fixing temperature is required to be switched at a time t35 that is earlier than the time t22 when the rear side of the identifier image passes through the fixing nip FN. In the case as shown in FIG. 26, the target fixing temperature is required to be switched at a time t33 that is later than the time t22 when the rear side of the identifier image passes through the fixing nip FN.

Therefore, in a case where the time when the target fixing temperature is switched to T3 may be later than the time t22 when the identifier image passes through the fixing nip, as in the case shown in FIG. 26 (NO in step S714), the time t22 when the identifier image passes through the fixing nip is set to the timing at which the target fixing temperature is switched from T2 to T1 (step S715).

The timing at which the target fixing temperature is switched to T3 is determined in consideration of the time t31 when the front side of the photo image arrives at the fixing nip and the temperature rise time required for the target fixing temperature to reach the temperature T3 (step S716).

Figure 26:
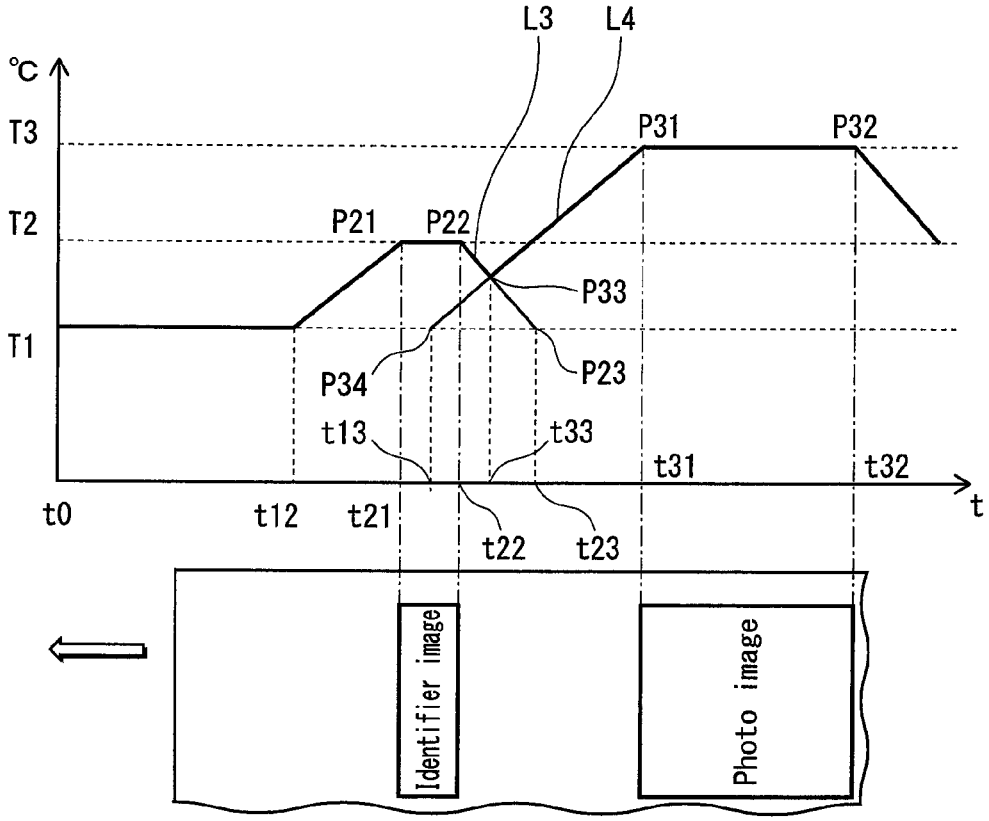
FIG. 26 is a diagram for explaining the third example of the specific timing determination method in the target fixing temperature switching timing determination processing 1 in Embodiment 3.

As in the case shown in FIG. 26 (i.e., when the time from passage of the rear side of the identifier image through the fixing nip to arrival of the front side of the succeeding photo image at the fixing nip is shorter than the sum of a time required for the temperature of the heating roller 41 to decrease from T2 to T1 and a time required for the temperature of the heating roller 41 to increase from T1 to T3), a time t33 at an intersection P33 of a temperature fall line L3 and a temperature rise line L4 is set to the timing at which the target fixing temperature is switched to T3. The equation for the temperature fall line L3 and the equation for the temperature rise line L4 can easily be acquired in a similar manner to the aforementioned temperature fall line L1 and temperature rise line L2 from the temperature fall gradient kb, the temperature rise gradient ka, and coordinates of points P22 and P31 that are each known.

Although not shown in FIG. 26, when a distance between the identifier image and the photo image is further increased, and coordinates of an intersection P34 of the temperature rise line L4 and a straight line indicated by an equation T=T1 coincides with or comes later than coordinates of an intersection P23 of the temperature fall line L3 and a straight line indicated by T=T1 (i.e., a time from passage of the rear side of the identifier image through the fixing nip to arrival of the front side of the succeeding photo image at the fixing nip is equal to or longer than the sum of the time required for the temperature to decrease from T2 to T1 and the time required for the temperature to increase from the T1 to T3), the time t13 at the point P34 is set to the timing at which the target fixing temperature is switched to T3.

When it is judged that the target fixing temperature is required to be switched to T3 before the identifier image passes through the fixing nip in step S714, processing in step S715 is skipped, and the timing at which the target fixing temperature is switched to T3 is determined in step S716.

Specifically, the time t35 at the intersection P35 of the temperature rise line L4 and a straight line indicated by T=T2 is set to the timing at which the target fixing temperature is switched to T3, as shown in FIG. 25.

A time t32 when the photo image passes through the fixing nip is set to a timing at which the target fixing temperature is switched from T3 to T1 (step S717), and processing returns to step S708 in FIG. 19.

Whether or not any high fixing temperature image remains in the image to be fixed is judged in step S708. When any high fixing temperature remains (YES in step S708), processing returns to step S701 to repeat the above-mentioned target fixing temperature switching timing determination processing. When no high fixing temperature remains (NO in step S708), processing returns to the flow chart of FIG. 17. The target fixing temperature switching timings determined in FIGS. 19 and 20 are stored in the target fixing temperature switching timing table that is similar to that shown in FIG. 8.

In step S511 in FIG. 17, the RIP processing is performed on image data on page N, and, after it is confirmed that the temperature of the heat roller 41 is equal to or higher than T1 (YES in step S512), a printing operation is started (step S513).

Temperature control is then performed by performing the target fixing temperature switching processing of switching the target fixing temperature based on the target fixing temperature switching timing table created in step S510 (step S514).

Figure 21:
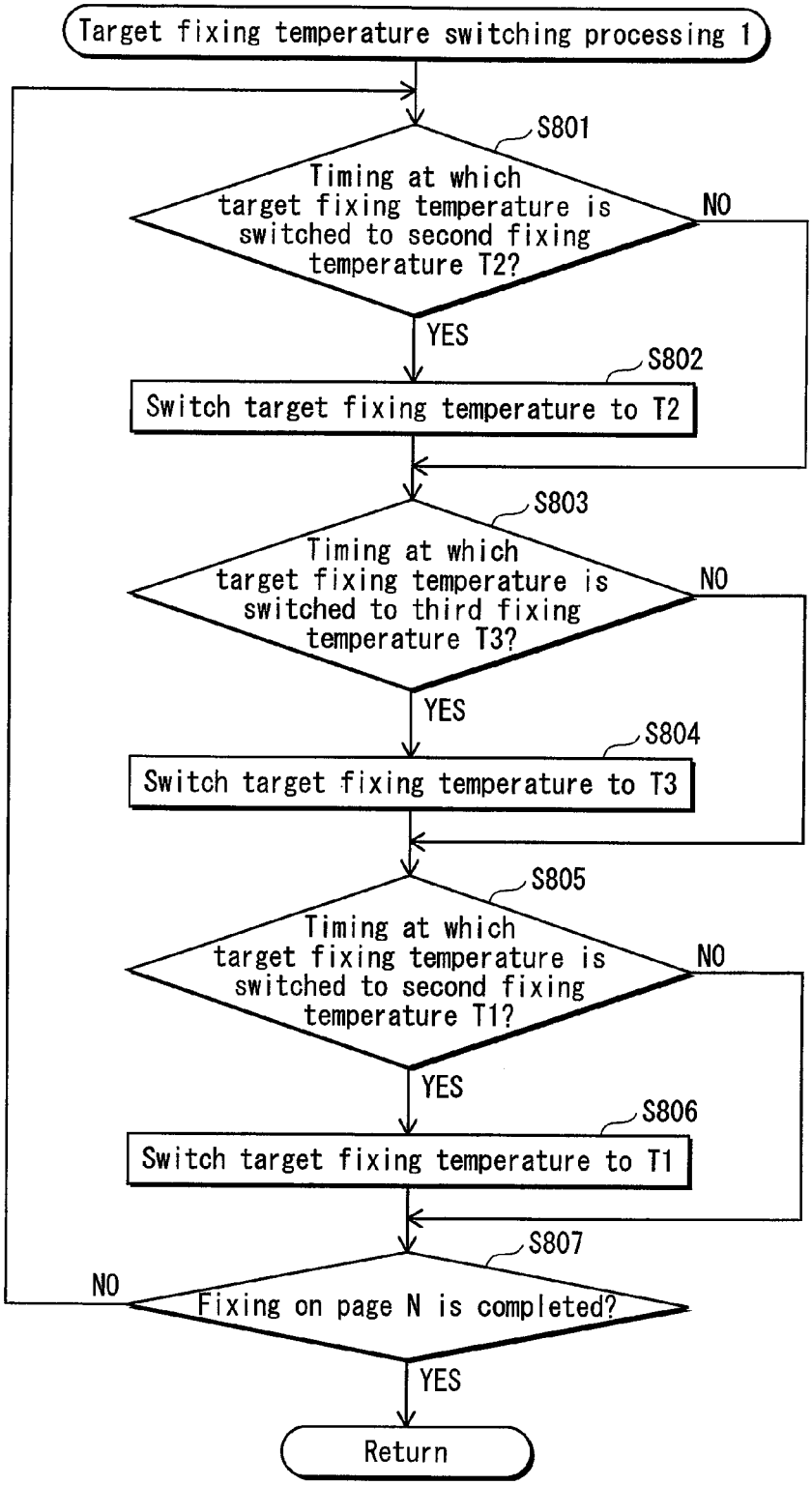
FIG. 21 is a flow chart showing a subroutine of target fixing temperature switching processing 1 in step S514 in FIG. 17.

FIG. 21 is a flow chart showing a subroutine of the target fixing temperature switching processing 1.

With reference to the target fixing temperature switching timing table created in the target fixing temperature switching timing determination processing in step S510 in FIG. 17, whether or not it is a timing at which the target fixing temperature is switched to the second fixing temperature T2, the third fixing temperature T3, and the first fixing temperature T1 is judged in steps S801, S803, and S805, respectively. When the result of the judgment is affirmative in these steps (YES in steps S801, S803, and S805), processing to switch the temperature to a corresponding fixing temperature is performed (steps S802, S804, and S806).

This processing of switching the target fixing temperature is performed until fixing of a toner image of an image on page N is completed (YES in step S807), and processing returns to the flow chart of FIG. 17.

Whether or not printing of all the pages has been completed is judged in step S523 in FIG. 17.

When printing of all the pages is not completed (NO in step S523), a value of N is incremented by one in step S524, and processing in and after step S505 is performed on image data on a succeeding page.

When printing of all the pages is completed (YES in step S523), driving of the halogen heater 43 is stopped (step S525), and temperature control processing for the job is completed.

When it is judged that image data on page N does not include a photo image in step S505 (NO in step S505), processing that is similar to the processing in steps S301 to S114 shown in FIG. 12 is performed in the present embodiment, as the processing is basically the same as that in Embodiment 2.

That is to say, the identifier image generated by the identifier image generation unit 62 is acquired (step S515), and identifier image addition position determination processing 2 to determine a position, on a page, at which the acquired identifier image is to be added is performed (step S516).

Since the subroutine of the identifier image addition position determination processing 2 is the same as that shown in FIG. 13, illustration and explanation thereof are omitted.

The identifier image is added at the position determined in step S516 (step S517), and the control unit 50 performs processing to determine a timing at which the target fixing temperature for control of the temperature of the heating roller 41 is switched (target fixing temperature switching timing determination processing 2) during fixing of a toner image of image data after addition of the identifier image (step S518).

Since this processing is the same as the subroutine of the target fixing temperature switching timing determination processing described with use of FIG. 6, illustration and explanation thereof are omitted.

In step S519, the RIP processing is performed on image data on page N after addition of the identifier image, and, after it is confirmed that the temperature of the heat roller 41 is equal to or higher than T1 (YES in step S520), a printing operation is started (step S521). In addition, the target fixing temperature switching processing 2 is performed (step S522).

In the target fixing temperature switching processing 2, the target fixing temperature switching timing table created in step S518 is read, and the target fixing temperature To is switched to the temperature T1 or the temperature T2 with reference to the time counted by the timer 59 to control the temperature of the heating roller 41 to be maintained at the fixing temperature to which the target fixing temperature is switched. The target fixing temperature switching processing 2 is not particularly illustrated as it is shown by a flow chart that is obtained by removing steps S803 and S804 from the flow chart showing the target fixing temperature switching processing 1.

In step S523, whether or not printing of images on all pages is completed is judged. When printing of images on all pages is not completed (NO in step S523), a value of N is incremented by one in step S524, and processing in and after step S505 is repeated on image data on a succeeding page.

When printing of all the pages is completed (YES in step S523), driving of the halogen heater 43 is stopped (step S525), and temperature control processing for the job is completed.

According to the present embodiment, when an image to be printed includes a photo image, a toner image of the photo image is fixed at the third fixing temperature to obtain a good image quality. Further, the identifier image can be added at a position with a high heat use efficiency in terms of the relation to a position of the photo image. As a result, maintenance of a good image quality and power saving are both achieved.

In the present embodiment, images on all the pages to be printed in a job are analyzed at a time to simulate a change of the fixing temperature on all the pages in step S504 in FIG. 17 while the identifier image addition position determination processing (see the flow chart of FIG. 18) is performed to determine a specific identifier image addition position in step S508. Even when images on all the pages are not analyzed at a time, however, as long as types and positions of images on at least three pages including a page currently targeted for the identifier image addition position, a page preceding the current page, and a page succeeding the current page are acquired, simulation of the fixing temperature in the range can be performed, and the judgment in steps S606 and S608 in FIG. 18 can be performed.

As described above, when image data in a job designated by a user as a target for image formation spans three or more pages, the CPU 51 recognizes a change of a fixing temperature, in the sheet-passing direction, based on an existing image on each page in units of at least three consecutive pages (a fixing temperature change recognition unit), and a position of the identifier image that is newly added is determined based on a fixing temperature at the rear end of a preceding page and a fixing temperature at the front end of a succeeding page acquired as a result of the recognition. This eliminates the need for control to frequently switch the target fixing temperature, and enables efficient fixing of a toner image of a high fixing temperature image on consecutive pages, leading to improvement of the power saving effect.

<Modifications>

The present invention is in no way limited to the embodiments and the configuration example as described above, and may be modified as shown below.

(1) In the target fixing temperature switching timing determination processing in each of the above-mentioned embodiments, when an image (text image) whose toner image is to be fixed at the first fixing temperature is interposed between an identifier image whose toner image is to be fixed at the second fixing temperature and a photo image whose toner image is to be fixed at the third fixing temperature in the sheet-passing direction on the same page, a timing is determined such that the target fixing temperature is once switched from the high fixing temperature to the first fixing temperature, and is then switched to the high fixing temperature again.

Figure 27A:
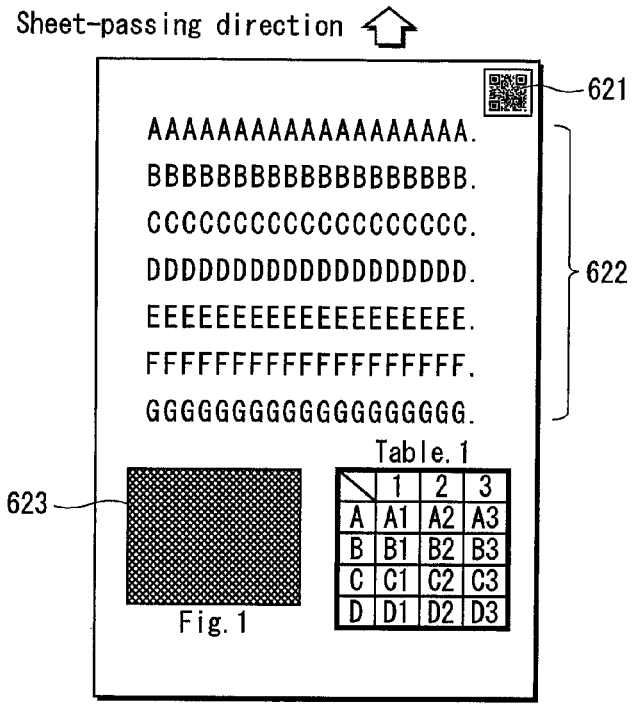
FIGS. 27A and 27B show a modification of target fixing temperature switching processing in Embodiment 3, and FIGS. 27A and 27B respectively show an original image, an image after addition of an identifier image, and ranges, on a recording sheet, in which the target fixing temperature should be set to a first fixing temperature and a second fixing temperature.
Figure 27B:
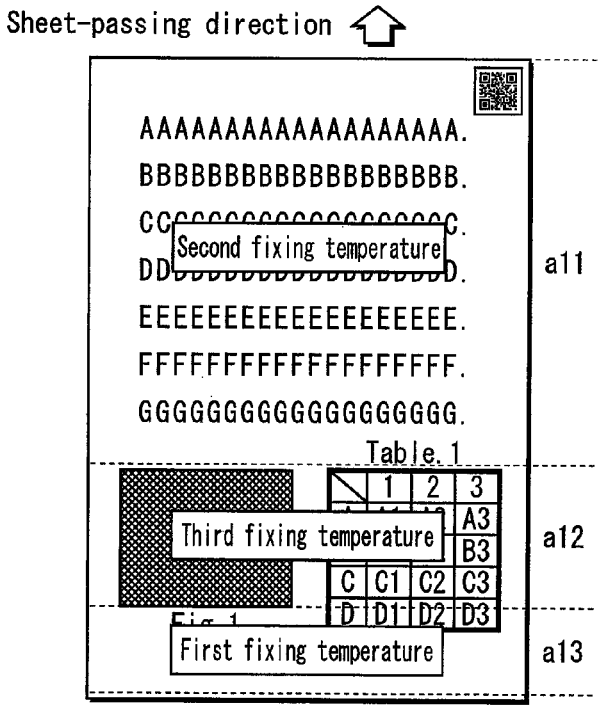

For example, however, when a text image 622 is interposed between a QR code 621 and a photo image 623 in the sheet-passing direction as shown in FIG. 27A, the target fixing temperature switching timing may be determined such that a toner image in a range a11 including the QR code 621 and the text image 622 is fixed at the second fixing temperature, a toner image in a range a12 including the photo image 623 is fixed at the third fixing temperature, and a toner image in a remaining range a13 is fixed at the first fixing temperature, as shown in FIG. 27B.

Since the flow chart of the target fixing temperature switching timing determination processing in the present modification is obtained by removing steps S714 and S715 in FIG. 20, illustration thereof is omitted.

Similarly, when a photo image, a text image, and an identifier image are arranged in this order, toner images of the text image and the identifier image may be fixed at the second fixing temperature after a toner image of the photo image is fixed at the third fixing temperature.

As described above, when an identifier image and another image whose toner image is to be fixed at a temperature equal to or higher than the second fixing temperature are arranged so as not to overlap each other in the sheet-passing direction in an image for one page, a toner image of any image interposed between the coded identifier image and the other image is fixed at the second fixing temperature. Although this produces a slight disadvantage that the power-saving effect is reduced compared to the above-mentioned embodiments, an advantage effect that control to switch the target fixing temperature is facilitated can be obtained. Especially when an image targeted for printing includes a photo image, arrangement of images as shown in FIGS. 27A and 27B is considered not to be caused frequently according to the identifier image addition position determination processing in Embodiment 3 (in particular, steps S601-S605 in FIG. 18).

(2) Each of the above-mentioned embodiments has been described on the assumption that the number of paper feed cassettes 31 included in the paper feeding unit 30 is one, and a recording sheet is set so that the longitudinal direction thereof is in parallel to the sheet conveyance direction (a lengthwise direction).

Figure 4A:
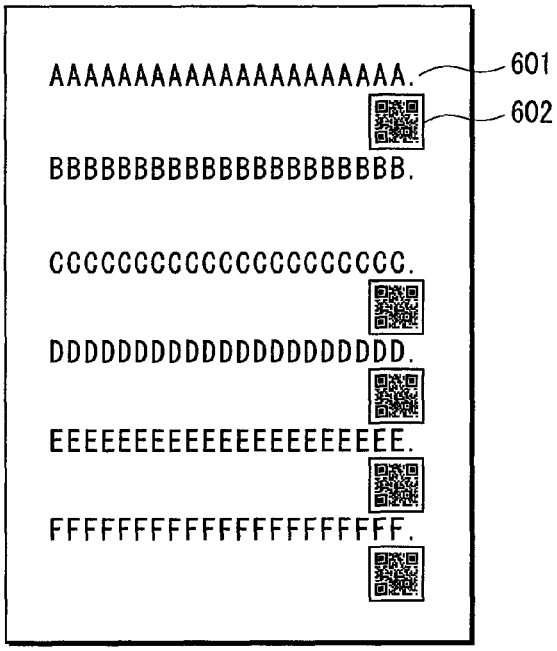
FIGS. 4A and 4B are diagrams for providing an overview of target fixing temperature switching processing in Embodiment 1.
Figure 4B:
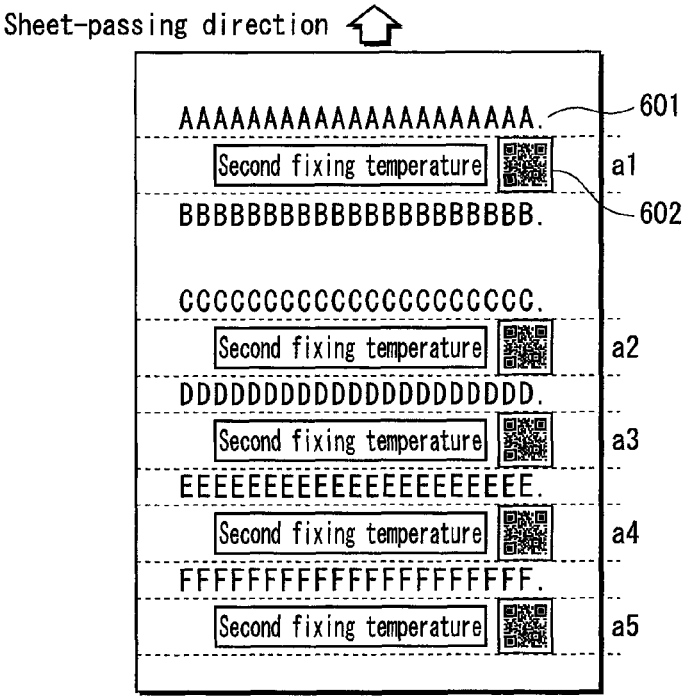

Therefore, when an image as shown in FIG. 4A is printed, processing is performed such that the temperature is frequently switched to the second fixing temperature as shown in FIG. 4B.

Figure 28:
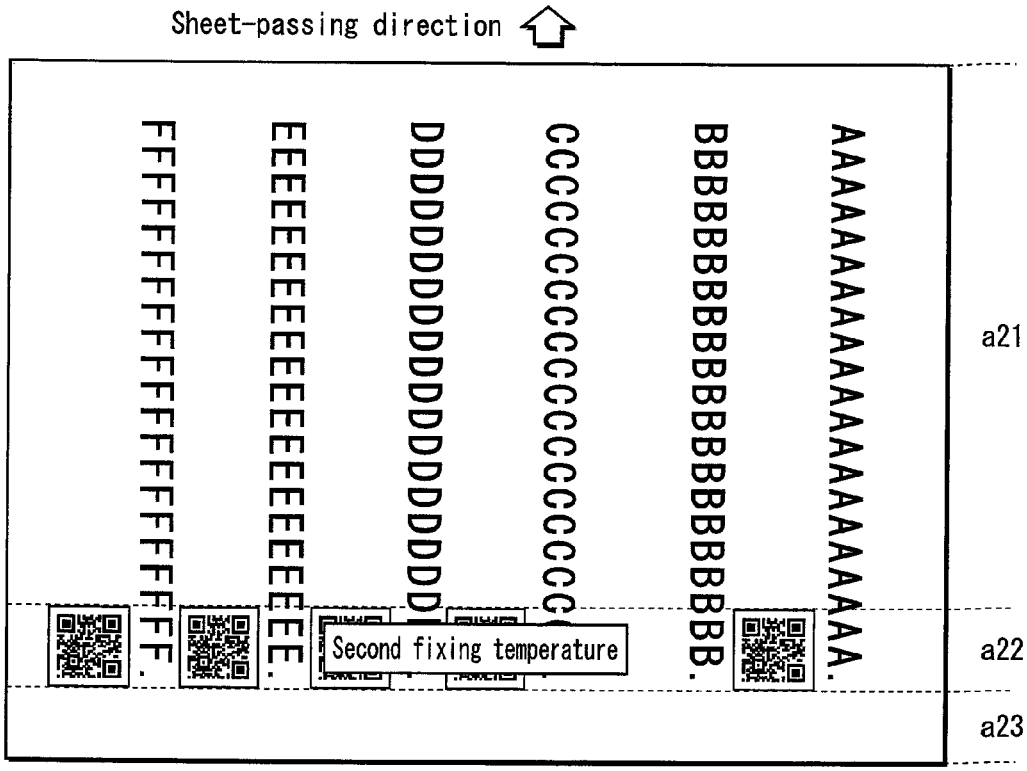
FIG. 28 shows a modification of the target fixing temperature switching processing in Embodiment 1.

When a plurality of identifier images are concentrated on one side of the recording sheet in the width direction of the recording sheet as shown in FIG. 4A, the recording sheet may be conveyed so that the lengthwise direction of the recording sheet is perpendicular to the sheet conveyance direction (a widthwise direction) as shown in FIG. 28. In this case, control is facilitated as the number of times the target fixing temperature is switched is small, and a range of formation of a toner image to be fixed at the second fixing temperature (a range a22 in FIG. 28) is narrow, contributing to power saving.

Therefore, as described above, when a copy job is performed with respect to a document sheet on which there are many high fixing temperature images, and the high fixing temperature images are concentrated on one side of a recording sheet in the width direction of the recording sheet, the recording sheet may be set in the paper feed cassette 31 in the widthwise direction, and the copy job may be performed by scanning the document sheet in the widthwise direction.

A typical digital image forming apparatus often has a function to cause the control unit to rotate an image. Use of this function allows for selection of a recording sheet in a sheet-passing direction that is superior in terms of power saving to perform image formation, regardless of a direction in which an original image is scanned.

Figure 29:
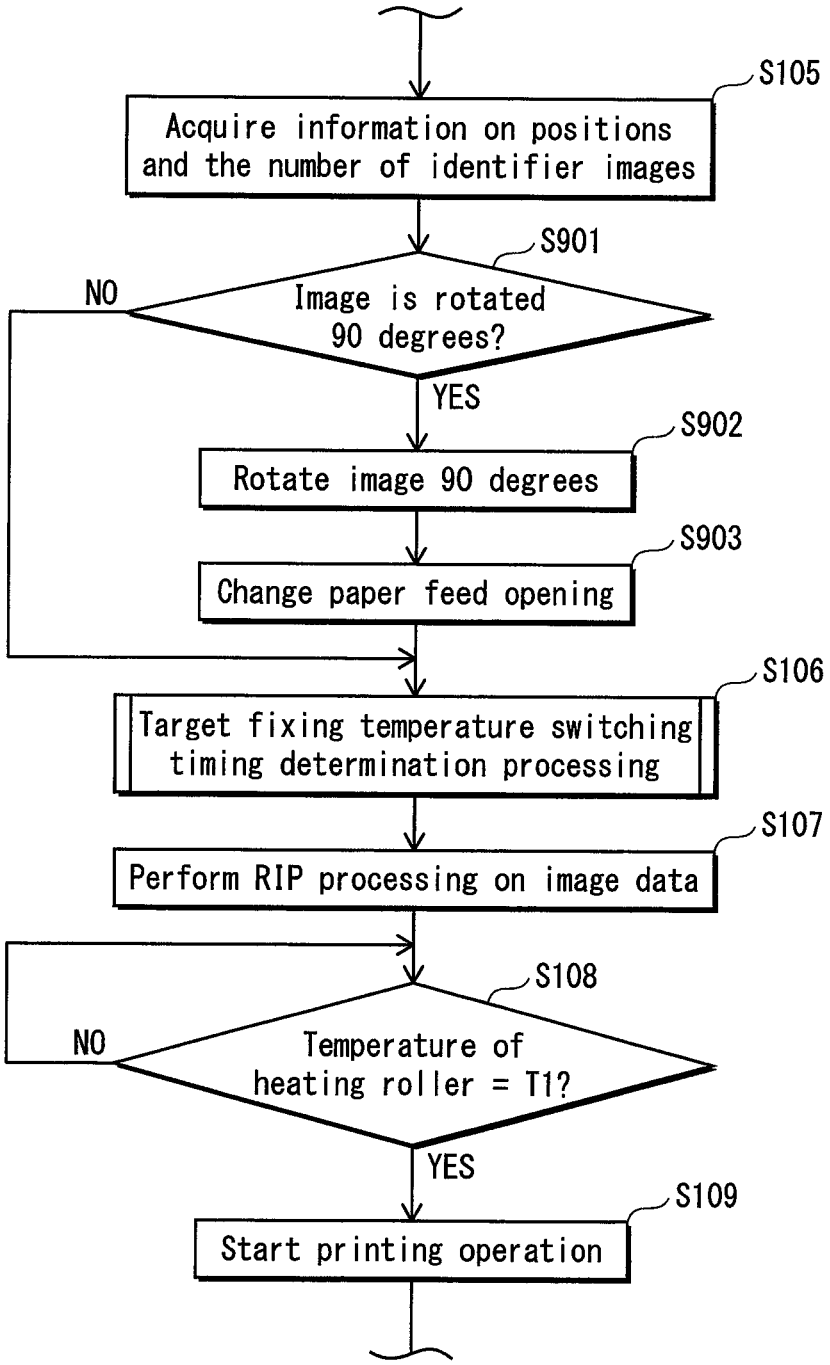
FIG. 29 is a partial flow chart showing characteristic processing in a flow chart showing temperature control processing in the above-mentioned modification.

FIG. 29 is a flow chart showing a modification to the temperature control processing performed by the control unit 50 in such a case. In order to avoid repetition in explanation, the flow chart is partially shown, and differences from the flow chart of FIG. 5 in Embodiment 1 are mainly described for convenience's sake. This modification is described on the assumption that two paper feed cassettes are included in the paper feeding unit 30, and recording sheets are set in the respective paper feed cassettes in the lengthwise direction and in the widthwise direction.

When information on positions and the number of identifier images is acquired in step S105, whether or not an image is to be rotated 90 degrees is judged based on the acquired information (step S901).

As described above, whether the image is required to be rotated is judged in terms of a power saving efficiency during fixing. Therefore, the sum of times required to perform fixing at the second fixing temperature in a case where a recording sheet passes in the same direction as an original image (the sum of ranges of formation of identifier images in the sheet-passing direction) may be compared with the sum of times required to perform fixing at the second fixing temperature in a case where the recording sheet is rotated 90 degrees and passes, and the direction in which the recording sheet passes may be judged so as to correspond to the direction of the recording sheet in a case where the sum of times is smaller.

As described above, in the case shown in FIG. 4A, it is clear that a time required to perform fixing at the second fixing temperature is shorter in a case where an image is rotated 90 degrees so that the recording sheet passes in the widthwise direction as shown in FIG. 28 than in a case where the recording sheet passes in the lengthwise direction, and the former case contributes more to power saving.

When it is judged that the image is to be rotated 90 degrees in step S901 (YES in step S901), the CPU 51 reads image data for the page, and rotates the image 90 degrees by a known image processing method, for example, by converting an address on memory of each of pixels constituting the image data into an address after rotating the image 90 degrees (step S902).

In order to remove the burden of causing ejected recording sheets to be in the same direction, it is desirable that a rotation direction be unified, for example, to the clockwise direction.

A paper feed opening (paper feed cassette) is switched to a paper feed opening in which recording sheets lie in a direction suitable for printing of the rotated image (step S903), the target fixing temperature switching timing processing is performed with respect to the image having been rotated 90 degrees (step S106), and processing in and after step S107 is performed.

In the present modification, whether or not an image is to be rotated 90 degrees may be judged based on a user's instruction from the operation panel 70 in step S901.

(3) In the above-mentioned embodiments, only the fixing temperature is increased to fix a toner image of a high fixing temperature image. However, another condition affecting fixing performance may also be changed accordingly.

For example, the width of the fixing nip in the sheet-passing direction may be increased by increasing a nip pressure at the fixing nip formed between the heating roller 41 and the pressing roller 42 to improve fixing performance.

Figure 30B:
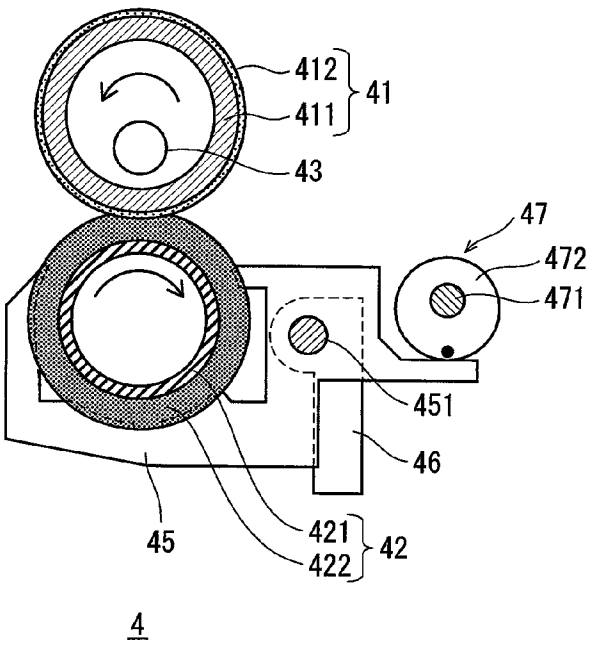
FIGS. 30A and 30B show a configuration example of a fixing unit when a fixing nip pressure is changed along with a fixing temperature.
Figure 30A:
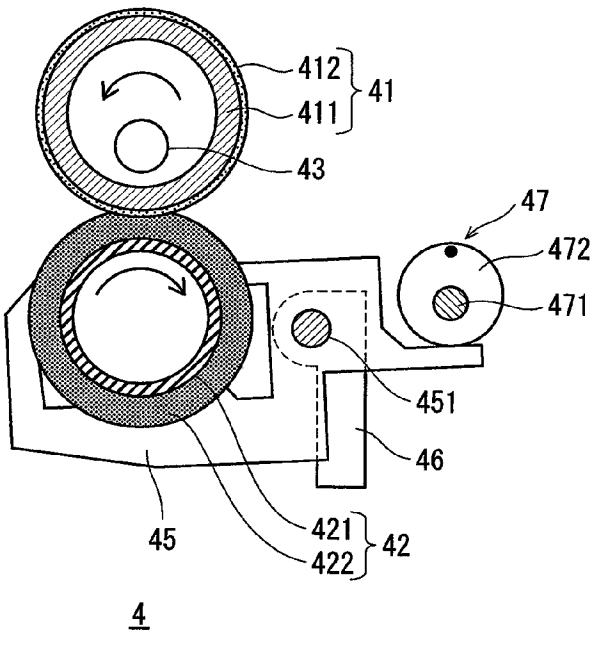

FIGS. 30A and 30B each show a principal part of the fixing unit 40 that can change the nip pressure at the fixing nip by using a cam mechanism.

The pressing roller 42 is rotatably borne by a swingable frame 45, and the swingable frame 45 is swingably supported by a support frame 46 within a body of the fixing unit 40 via a support shaft 451.

The cam mechanism 47 includes a cam 472, a drive shaft 471, and a drive source (not illustrated) for driving the drive shaft 471 to rotate.

A portion of the swingable frame 45 located opposite the bearing portion of the pressing roller 42 with the support shaft 451 therebetween is in contact with the cam 472. By rotating the drive shaft 471 of the cam 472 by using the drive source, the swingable frame 45 swings from a position shown in FIG. 30A to a position shown in FIG. 30B to reduce a distance between the axis of the pressing roller 42 and the axis of the heating roller 41. By an elastic force of the elastic layer 422 of the pressing roller 42 and an elastic force of the elastic layer 411 of the heating roller 41, a nip pressure at the fixing nip is increased.

As a result, the width of the fixing nip is increased, and fixing performance of a toner image is improved as a passing recording sheet becomes likely to receive heat from the heating roller 41.

The mechanism for changing the nip pressure at the fixing nip is not limited to that shown in FIG. 30, and any other known mechanism may be adopted.

In a similar manner to the above-mentioned target fixing temperature switching timing determination processing, a timing at which the nip pressure is switched is determined in advance by simulation before the start of a printing operation on the page.

That is to say, a drive time tf required to transition from a state shown in FIG. 30A to a state shown in FIG. 30B is acquired in advance, and a time that is the time tf earlier than a time when a high fixing temperature image on the recording sheet arrives at the fixing nip is set to a timing at which the nip pressure is switched from a first nip pressure to a second nip pressure. In addition, a time when the high fixing temperature image passes through the fixing nip is set to a timing at which the nip pressure is switched from the second nip pressure to the first nip pressure. The nip pressure may be switched with reference to the table as described above.

(4) In the above-mentioned embodiments, examples of the fixing unit using the halogen heater 43 as a heat source are described. However, another configuration may be adopted as long as a heating unit for supplying heat to fuse a toner image is included.

Especially an electromagnetic induction type fixing device that can generate heat in a fixing belt having a metal layer by generating an alternating magnetic field by using an exciting coil, and by generating eddy current in the metal layer, and a heating resistor type fixing device that can generate heat by providing a heating resistor layer on the fixing belt, and allowing current to pass through the heating resistor layer are desirable as they have a high rate of temperature rise and a high followability.

(5) In the above-mentioned embodiments, a QR code as a two-dimensional code is taken as an example of the identifier image. The identifier image, however, may be other two-dimensional codes, such as a PDF 417 (registered trademark), Data Matrix (registered trademark), and MaxiCode (registered trademark), and may be a one-dimensional code, such as a bar code.

(6) In the above-mentioned embodiments, a copying machine performs a print job received from a terminal and a copy job of scanning an original image by using a scanner and printing the scanned image. A source of image data targeted for printing is not limited to that described in the above-mentioned embodiments. When the copying machine has a facsimile function, the image data may be image data received by a facsimile. When the copying machine has a function to be connected to portable memory, such as USB memory and an SD card (registered trademark), to perform printing (a direct printing function), image data stored in the portable memory may be used.

Further, when the copying machine has a function to file image data previously scanned by a scanner and image data previously printed out in internal storage memory, such as a hard disk drive, and can select and print the image data or can access an external server to acquire the image data and print the acquired image data, image data acquired from the storage memory or the server may be used.

Therefore, the present invention is applicable not only to the above-mentioned copying machine but also a multi-function machine having a function other than a copying function and a printing function, a printing-dedicated machine, a facsimile-dedicated machine, and a monochrome printing-dedicated image forming apparatus. To sum up, the present invention is applicable to all types of image forming apparatus including a fixing device for performing thermal fixing.

The embodiments and modifications as described above may be combined with each other if at all possible.

For example, when an identifier image has already been added to an original image, and the image forming apparatus further adds another identifier image in which coded information is embedded, Embodiment 1 and Embodiment 2 (or Embodiment 3) may be combined with each other.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An image forming apparatus that forms an image by causing a recording sheet on which an unfixed toner image is formed to pass through a fixing nip, and thermally fixing the toner image onto the recording sheet, the fixing nip being formed by pressing a pressing member against a fixing member that is heated, the image forming apparatus comprising:

a heater heating the fixing member;

an acquisition unit acquiring, when an image for one page includes a coded identifier image in which coded information is embedded, information on a range of formation of the coded identifier image on the recording sheet, the range being defined in terms of a sheet-passing direction;

a target temperature switching unit switching a target temperature, the target temperature being a temperature at which a temperature of the fixing member is to be maintained, and the target temperature being switched at least between a first fixing temperature and a second fixing temperature that is higher than the first fixing temperature; and a controller controlling the heater so that the temperature of the fixing member is maintained at the target temperature to which the target temperature switching unit has switched, wherein the target temperature switching unit switches the target temperature at a timing such that the temperature of the fixing member is equal to the second fixing temperature while a toner image in the range of formation of the coded identifier image is being fixed.

2. The image forming apparatus of claim 1, wherein the first fixing temperature is a temperature to be set when a toner image of a text image is fixed.

3. The image forming apparatus of claim 1, wherein the target temperature switching unit switches the target temperature to the second fixing temperature at a timing such that the temperature of the fixing member reaches the second fixing temperature by a time a toner image of the coded identifier image arrives at the fixing nip.

4. The image forming apparatus of claim 1, wherein the acquisition unit includes an identifier judgment unit judging whether or not an original image includes the coded identifier image, and wherein the acquisition unit acquires the information on the range for each page in which the coded identifier image is judged to be included.

5. The image forming apparatus of claim 1, further comprising an identifier image addition unit newly adding the coded identifier image to an original image, wherein the acquisition unit acquires the information on the range for each page to which the coded identifier image is added by the identifier image addition unit.

6. The image forming apparatus of claim 5, wherein in performing operations to form images for a plurality of pages continuously, when a page to which the coded identifier image is to be newly added is a first page on which fixing is performed first, the identifier image addition unit newly adds the coded identifier image at a position in a margin at a rear end, in the sheet-passing direction, of a recording sheet on which an original image for the first page is formed.

7. The image forming apparatus of claim 5, wherein in performing operations to form images for a plurality of pages continuously, when a page to which the coded identifier image is to be newly added is a last page on which fixing is performed last, the identifier image addition unit newly adds the coded identifier image at a position in a margin at a front end, in the sheet-passing direction, of a recording sheet on which an original image for the last page is formed.

8. The image forming apparatus of claim 5, wherein in performing operations to form images for a plurality of pages continuously, when the coded identifier image is added at a position in a margin at a rear end, in the sheet-passing direction, of a recording sheet on which an original image for a preceding page is formed, the identifier image addition unit newly adds the coded identifier image at a position in a margin at a front end, in the sheet-passing direction, of a recording sheet on which an original image for a succeeding page is formed.

9. The image forming apparatus of claim 5, wherein as for a page to which the coded identifier image is to be newly added, when there is a difference in sizes of margins, in the sheet-passing direction, of a recording sheet on which an original image for the page is formed, the identifier image addition unit newly adds the coded identifier image at a position in a margin having a smaller size.

10. The image forming apparatus of claim 5, wherein when an image for one page includes a gradation image, the acquisition unit further acquires information on a range of formation of the gradation image on the recording sheet, the range being defined in terms of the sheet-passing direction, and the target temperature switching unit further switches the target temperature to a third fixing temperature that is higher than the second fixing temperature, and switches the target temperature at a timing such that the temperature of the fixing member is equal to the third fixing temperature while a toner image in the range of formation of the gradation image is being fixed.

11. The image forming apparatus of claim 5, wherein when an original image for a page to which the coded identifier image is to be newly added includes another image whose toner image is to be fixed at a temperature equal to or higher than the second fixing temperature, the identifier image addition unit newly adds the coded identifier image at a position in a margin that is the closest to the other image.

12. The image forming apparatus of claim 11, wherein when there is a margin at a front side, in the sheet-passing direction, of the other image, the identifier image addition unit newly adds the coded identifier image at a position in the margin at the front side of the other image.

13. The image forming apparatus of claim 1, wherein when, in an image for one page, the coded identifier image and another image whose toner image is to be fixed at a temperature equal to or higher than the second fixing temperature are arranged so as not to overlap each other in the sheet-passing direction, the target temperature switching unit switches the target temperature so that a toner image of any image interposed between the coded identifier image and the other image is fixed at the second fixing temperature.

14. The image forming apparatus of claim 5, further comprising a fixing temperature change recognition unit recognizing, when image data in one job of image formation spans three or more pages, a change of a fixing temperature, in the sheet-passing direction, on each page caused by switching the target fixing temperature in units of at least three consecutive pages, wherein the identifier image addition unit determines a position of the coded identifier image newly added to a page other than a first page and a last page based on a fixing temperature at a rear end of a preceding page and a fixing temperature at a front end of a succeeding page obtained as a result of the recognition.

15. The image forming apparatus of claim 1, further comprising:

an image rotating unit rotating an image to be formed by 90 degrees;

a sheet feeding unit selectively feeding a first sheet and a second sheet, a direction in which the first sheet passes being different from a direction in which the second sheet passes by 90 degrees; and a determination unit determining, based on a position of an image whose toner image is to be fixed at a temperature equal to or higher than the second fixing temperature, whether or not the image is required to be rotated and which sheet is to be fed to form the image.

16. The image forming apparatus of claim 1, further comprising:

a fixing nip pressure switching unit switching a nip pressure at the fixing nip between a first nip pressure and a second nip pressure that is higher than the first nip pressure; and a nip pressure switching instruction unit instructing the fixing nip pressure switching unit to switch the nip pressure at a timing such that the nip pressure is equal to the second nip pressure while a toner image that is required to be fixed at a temperature equal to or higher than the second fixing temperature is being fixed.

* * * * *